United States Patent [19]

Dillinger et al.

[11] 3,942,620

[45] Mar. 9, 1976

[54] PRINTING MECHANISM

[75] Inventors: James Roland Dillinger; Robert Frederick Herald, both of Rochester; Irving Lionel Miller, Pine Island, all of Minn.

[73] Assignee: International Business Machines Corporation, Armonk, N.Y.

[22] Filed: July 25, 1974

[21] Appl. No.: 491,968

[52] U.S. Cl. ..... 197/1 R; 101/93.05

[51] Int. Cl.[2] ..... B41J 3/04

[58] Field of Search ..... 197/1 R, 5; 101/93.04, 101/93.05; 178/23 R, 30; 340/172.5

[56] References Cited

UNITED STATES PATENTS

| | | | |
|---|---|---|---|
| 3,627,096 | 12/1971 | Finnegan | 197/1 R |
| 3,757,346 | 9/1973 | Holland | 346/1 |
| 3,759,359 | 9/1973 | Stellmach | 197/1 R |
| 3,814,227 | 6/1974 | Hurd | 197/1 R |
| 3,893,558 | 7/1975 | Fulton et al. | 197/1 R |

*Primary Examiner*—Edgar S. Burr
*Assistant Examiner*—R. T. Rader
*Attorney, Agent, or Firm*—Keith T. Bleuer

[57] ABSTRACT

A printer of the wire type including 8 print wires disposed in a row and each actuatable by an electromagnet for printing individual characters defined by eight dots high and seven dots wide on a longitudinally movable ticket medium. The printing mechanism is also capable of printing fractions including numerators defined by the top six print wires and denominators defined by the bottom six wires together with a diagonally extending slash mark the printed dots of which lie within the seven dot wide character areas and a three dots wide normally blank area between characters. The printing mechanism may be so controlled either by a hardware embodiment of control or a micro controller.

5 Claims, 19 Drawing Figures

| FIG. 14a | FIG. 14b |
|---|---|

ROS Address Register

| 0 | 1 | 2 | 3 | 4 | 5 | 6 | 7 | 8 | 9 |
|---|---|---|---|---|---|---|---|---|---|

246

ROS PRINT MATRIX TABLE

| | | 0 | 1 | 2 | 3 | 4 | 5 | 6 | 7 | 8 | 9 | A | B | C | D | E | F | |
|---|---|---|---|---|---|---|---|---|---|---|---|---|---|---|---|---|---|---|
| | 0 | $b_0$ | $b_1$ | $b_2$ | $b_3$ | $b_4$ | $b_5$ | $b_6$ | | $A_0$ | $A_1$ | $A_2$ | $A_3$ | $A_4$ | $A_5$ | $A_6$ | | |
| | 1 | $B_0$ | $B_1$ | $B_2$ | $B_3$ | $B_4$ | $B_5$ | $B_6$ | | $C_0$ | $C_1$ | $C_2$ | $C_3$ | $C_4$ | $C_5$ | $C_6$ | | |
| | 2 | $D_0$ | $D_1$ | $D_2$ | $D_3$ | $D_4$ | $D_5$ | $D_6$ | | $E_0$ | $E_1$ | $E_2$ | $E_3$ | $E_4$ | $E_5$ | $E_6$ | | |
| | 3 | $F_0$ | $F_1$ | $F_2$ | $F_3$ | $F_4$ | $F_5$ | $F_6$ | | $G_0$ | $G_1$ | $G_2$ | $G_3$ | $G_4$ | $G_5$ | $G_6$ | | |
| | 4 | $H_0$ | $H_1$ | $H_2$ | $H_3$ | $H_4$ | $H_5$ | $H_6$ | | $I_0$ | $I_1$ | $I_2$ | $I_3$ | $I_4$ | $I_5$ | $I_6$ | | |
| | 5 | $¢_0$ | $¢_1$ | $¢_2$ | $¢_3$ | $¢_4$ | $¢_5$ | $¢_6$ | | $\cdot_0$ | $\cdot_1$ | $\cdot_2$ | $\cdot_3$ | $\cdot_4$ | $\cdot_5$ | $\cdot_6$ | | |
| | 6 | $\underline{Ø}_0$ | $\underline{Ø}_1$ | $\underline{Ø}_2$ | $\underline{Ø}_3$ | $\underline{Ø}_4$ | $\underline{Ø}_5$ | $\underline{Ø}_6$ | | $\underline{1}_0$ | $\underline{1}_1$ | $\underline{1}_2$ | $\underline{1}_3$ | $\underline{1}_4$ | $\underline{1}_5$ | $\underline{1}_6$ | | |
| Ø | 7 | $+_0$ | $+_1$ | $+_2$ | $+_3$ | $+_4$ | $+_5$ | $+_6$ | | $\underline{2}_0$ | $\underline{2}_1$ | $\underline{2}_2$ | $\underline{2}_3$ | $\underline{2}_4$ | $\underline{2}_5$ | $\underline{2}_6$ | | I |
| | 8 | $\underline{3}_0$ | $\underline{3}_1$ | $\underline{3}_2$ | $\underline{3}_3$ | $\underline{3}_4$ | $\underline{3}_5$ | $\underline{3}_6$ | | $J_0$ | $J_1$ | $J_2$ | $J_3$ | $J_4$ | $J_5$ | $J_6$ | | |
| | 9 | $K_0$ | $K_1$ | $K_2$ | $K_3$ | $K_4$ | $K_5$ | $K_6$ | | $L_0$ | $L_1$ | $L_2$ | $L_3$ | $L_4$ | $L_5$ | $L_6$ | | |
| | A | $M_0$ | $M_1$ | $M_2$ | $M_3$ | $M_4$ | $M_5$ | $M_6$ | | $N_0$ | $N_1$ | $N_2$ | $N_3$ | $N_4$ | $N_5$ | $N_6$ | | |
| | B | $O_0$ | $O_1$ | $O_2$ | $O_3$ | $O_4$ | $O_5$ | $O_6$ | | $P_0$ | $P_1$ | $P_2$ | $P_3$ | $P_4$ | $P_5$ | $P_6$ | | |
| | C | $Q_0$ | $Q_1$ | $Q_2$ | $Q_3$ | $Q_4$ | $Q_5$ | $Q_6$ | | $R_0$ | $R_1$ | $R_2$ | $R_3$ | $R_4$ | $R_5$ | $R_6$ | | |
| | D | $\underline{4}_0$ | $\underline{4}_1$ | $\underline{4}_2$ | $\underline{4}_3$ | $\underline{4}_4$ | $\underline{4}_5$ | $\underline{4}_6$ | | $\$_0$ | $\$_1$ | $\$_2$ | $\$_3$ | $\$_4$ | $\$_5$ | $\$_6$ | | 276 |
| | E | $1/_0$ | $1/_1$ | $1/_2$ | $1/_3$ | $1/_4$ | $1/_5$ | $1/_6$ | | $3/_0$ | $3/_1$ | $3/_2$ | $3/_3$ | $3/_4$ | $3/_5$ | $3/_6$ | | |
| | F | $5/_0$ | $5/_1$ | $5/_2$ | $5/_3$ | $5/_4$ | $5/_5$ | $5/_6$ | | $7/_0$ | $7/_1$ | $7/_2$ | $7/_3$ | $7/_4$ | $7/_5$ | $7/_6$ | | |
| 1 | 0 | $-_0$ | $-_1$ | $-_2$ | $-_3$ | $-_4$ | $-_5$ | $-_6$ | | $/_0$ | $/_1$ | $/_2$ | $/_3$ | $/_4$ | $/_5$ | $/_6$ | | |
| | 1 | $S_0$ | $S_1$ | $S_2$ | $S_3$ | $S_4$ | $S_5$ | $S_6$ | | $T_0$ | $T_1$ | $T_2$ | $T_3$ | $T_4$ | $T_5$ | $T_6$ | | |
| | 2 | $U_0$ | $U_1$ | $U_2$ | $U_3$ | $U_4$ | $U_5$ | $U_6$ | | $V_0$ | $V_1$ | $V_2$ | $V_3$ | $V_4$ | $V_5$ | $V_6$ | | |
| | 3 | $W_0$ | $W_1$ | $W_2$ | $W_3$ | $W_4$ | $W_5$ | $W_6$ | | $X_0$ | $X_1$ | $X_2$ | $X_3$ | $X_4$ | $X_5$ | $X_6$ | | |
| | 4 | $4_0$ | $4_1$ | $4_2$ | $4_3$ | $4_4$ | $4_5$ | $4_6$ | | $Z_0$ | $Z_1$ | $Z_2$ | $Z_3$ | $Z_4$ | $Z_5$ | $Z_6$ | | |
| | 5 | $\underline{5}_0$ | $\underline{5}_1$ | $\underline{5}_2$ | $\underline{5}_3$ | $\underline{5}_4$ | $\underline{5}_5$ | $\underline{5}_6$ | | $,_0$ | $,_1$ | $,_2$ | $,_3$ | $,_4$ | $,_5$ | $,_6$ | | |
| | 6 | $\%_{00}$ | $\%_{01}$ | $\%_{02}$ | $\%_{03}$ | $\%_{04}$ | $\%_{05}$ | $\%_{06}$ | | $\underline{6}_0$ | $\underline{6}_1$ | $\underline{6}_2$ | $\underline{6}_3$ | $\underline{6}_4$ | $\underline{6}_5$ | $\underline{6}_6$ | | |
| 1 | 7 | $\underline{7}_0$ | $\underline{7}_1$ | $\underline{7}_2$ | $\underline{7}_3$ | $\underline{7}_4$ | $\underline{7}_5$ | $\underline{7}_6$ | | $\underline{8}_0$ | $\underline{8}_1$ | $\underline{8}_2$ | $\underline{8}_3$ | $\underline{8}_4$ | $\underline{8}_5$ | $\underline{8}_6$ | | II |
| | 8 | $Ø_0$ | $Ø_1$ | $Ø_2$ | $Ø_3$ | $Ø_4$ | $Ø_5$ | $Ø_6$ | | $1_0$ | $1_1$ | $1_2$ | $1_3$ | $1_4$ | $1_5$ | $1_6$ | | |
| | 9 | $2_0$ | $2_1$ | $2_2$ | $2_3$ | $2_4$ | $2_5$ | $2_6$ | | $3_0$ | $3_1$ | $3_2$ | $3_3$ | $3_4$ | $3_5$ | $3_6$ | | |
| | A | $4_0$ | $4_1$ | $4_2$ | $4_3$ | $4_4$ | $4_5$ | $4_6$ | | $5_0$ | $5_1$ | $5_2$ | $5_3$ | $5_4$ | $5_5$ | $5_6$ | | |
| | B | $6_0$ | $6_1$ | $6_2$ | $6_3$ | $6_4$ | $6_5$ | $6_6$ | | $7_0$ | $7_1$ | $7_2$ | $7_3$ | $7_4$ | $7_5$ | $7_6$ | | |
| | C | $8_0$ | $8_1$ | $8_2$ | $8_3$ | $8_4$ | $8_5$ | $8_6$ | | $9_0$ | $9_1$ | $9_2$ | $9_3$ | $9_4$ | $9_5$ | $9_6$ | | |
| | D | $\underline{9}_0$ | $\underline{9}_1$ | $\underline{9}_2$ | $\underline{9}_3$ | $\underline{9}_4$ | $\underline{9}_5$ | $\underline{9}_6$ | | $\#_0$ | $\#_1$ | $\#_2$ | $\#_3$ | $\#_4$ | $\#_5$ | $\#_6$ | | |
| | E | $@_0$ | $@_1$ | $@_2$ | $@_3$ | $@_4$ | $@_5$ | $@_6$ | | $'2_0$ | $'2_1$ | $'2_2$ | $'2_3$ | $'2_4$ | $'2_5$ | $'2_6$ | | |
| | F | $'4_0$ | $'4_1$ | $'4_2$ | $'4_3$ | $'4_4$ | $'4_5$ | $'4_6$ | | $'8_0$ | $'8_1$ | $'8_2$ | $'8_3$ | $'8_4$ | $'8_5$ | $'8_6$ | | |

276

| | | | | | | | | | | | | | | | | | | |
|---|---|---|---|---|---|---|---|---|---|---|---|---|---|---|---|---|---|---|
| Ø | Ø | E | $'_0$ | $'_1$ | $'_2$ | | | | | | | | | | | | | III |

FIG. 15

PRINTING MECHANISM

BACKGROUND OF THE INVENTION

The invention relates to printing apparatus and more particularly to a so-called wire printer which makes data impressions in the form of a mosaic pattern of dots produced by the wires of the printer as the form, such as connected tickets, on which the printing is done travels longitudinally across the ends of the wires.

Previous wire printers have been capable of printing fractions. Such wire printers generally have included a row of seven print wires each actuated by an electromagnet and capable of producing the digits of a fraction together with a diagonal line between the digits indicating that two consecutively printed digits together constitute a fraction. Each of the digits were of normal size, that is, the same size as alphabetic characters also printable by the printing mechanism; and the slash mark between two consecutive digits utilized the same printing width as each of the digits.

SUMMARY OF THE INVENTION

It is an object of the invention to provide an improved printing mechanism of the wire printer type by means of which it is possible to print digits for a numerator and a denominator of a fraction which are of less height than the alphanumeric characters normally printed by the printing mechanism, whereby the slash mark between the numerator and denominator may be made to extend diagonally into the normal printing areas for both the numerator and the denominator to shorten the length of the fraction on the printed surface.

In this connection, it is an object of the invention to provide a wire printer having eight wires disposed in a row, with the top six wires being capable of providing the digit for the numerator of a fraction and the lower six wires being capable of providing the digit for the denominator and with all of the wires being utilizable for producing the slash mark between the two digits.

BRIEF DESCRIPTION OF THE DRAWINGS

FIG. 15 is a table showing the contents of a read only store which is a part of the FIG. 14 circuit;

DESCRIPTION OF THE PREFERRED EMBODIMENT

Figure 1:
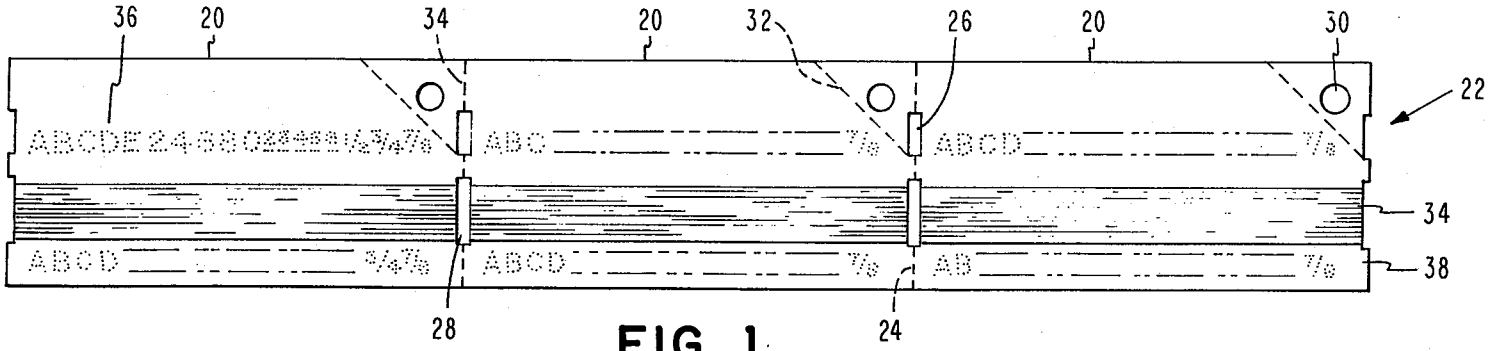
FIG. 1 is a face view of a strip of tickets with which the printing mechanism of the invention may be used.
Figure 4:
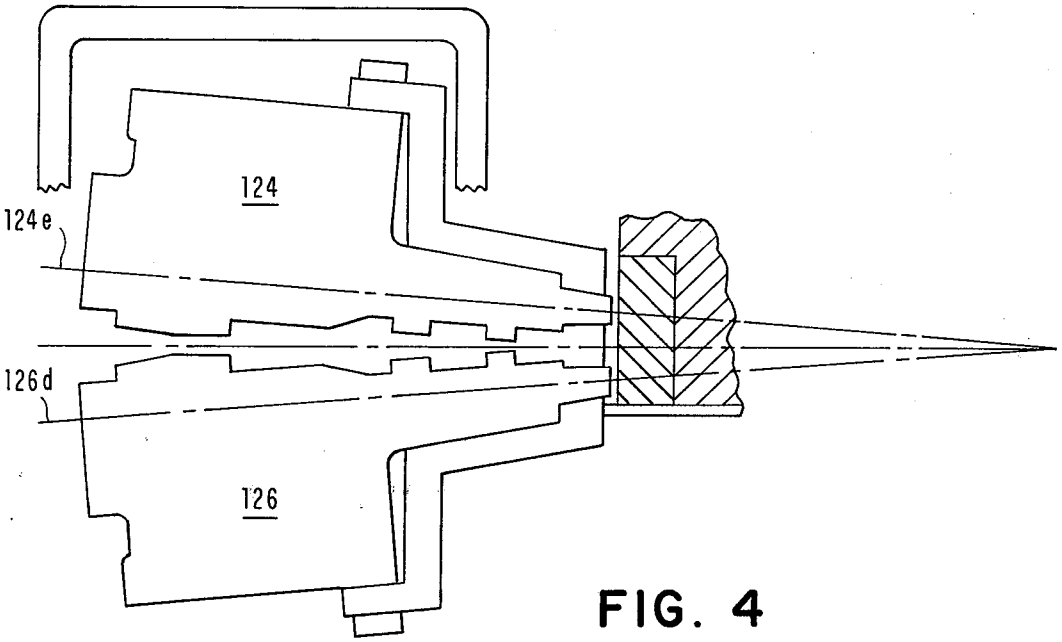
FIG. 4 is a sectional view on an enlarged scale of the printing mechanism of the invention including a plurality of print wires and electromagnets for moving the print wires, the view being taken on line 4—4 of FIG. 2.

Tickets of a type suitable for use with the printing mechanism of the present invention are illustrated in FIG. 1. The tickets 20 illustrated in FIG. 1 may, for example, be about two inches in length (or may be 1 inch or 3 inches long) and are in a continuous strip 22, being separated from adjacent tickets in the strip 22 by means of perforations lines 24. A relatively short slot 26 and a relatively long slot 28 are disposed in each of the perforation lines 24. Each of the tickets 20 has a round hole 30 in one corner, and a slantwise extending perforation line 32 divides this corner of the ticket 20 with respect to the rest of the ticket. As will be noted, the perforation line 32 does not pass through the opening 30.

Each of the tickets 20 has a stripe 34 of magnetic material extending longitudinally of the ticket on the upper surface of the ticket (which is illustrated in FIG. 1). The stripe may be applied onto the ticket 20 and onto the strip 22 by any suitable means. It will be noted that the slots 28 are longer than the width of the stripes 34 and separate the stripes 34 of adjacent tickets 20. The slots 26 are outside of the stripes 34. Print lines 36 and 38 are applied onto the tickets 20, respectively above and below the stripes 34.

The tickets 20 may, for example, be used in connection with articles for sale such as garments, for example men's suits and women's dresses. When used in this connection, a ticket 20 is detached from adjacent tickets 20 in the strip 22; and the ticket is fastened onto the garment by means of a small plastic anchor that extends through the opening 30 and through the garment. The magnetic stripe 34 has been magnetically encoded using the machine which is disclosed in the copending application of Lonald L. Amundson et al., Ser. No. 371,319, filed June 18, 1973, which is disclosed in simplified form in FIG. 2 hereof and with which the printing mechanism of the invention is used. The encoding of the magnetic stripe 34 of each ticket 20 may be with size, type, and print information, for example; and some of this information is printed by the printing mechanism of the present invention in print lines 36 and 38 by the FIG. 2 machine, so that the information is in human readable form. When the article is sold, the ticket is broken into two parts by tearing along the perforation line 32, and the information carried by the stripe 34 is then decoded by any suitable means, such as, for example, using the machine shown in FIG. 2. The corner of the ticket 20 through which the opening 30 has been provided remains attached to the garment by means of the anchor.

Although the tickets 20 are shown in connected form in FIG. 1, these tickets may also be used in the FIG. 2 machine in individual form, with the tickets 20 being fed through the machine one after the other, as will be more specifically described in connection with the FIG. 2 machine.

Figure 2:
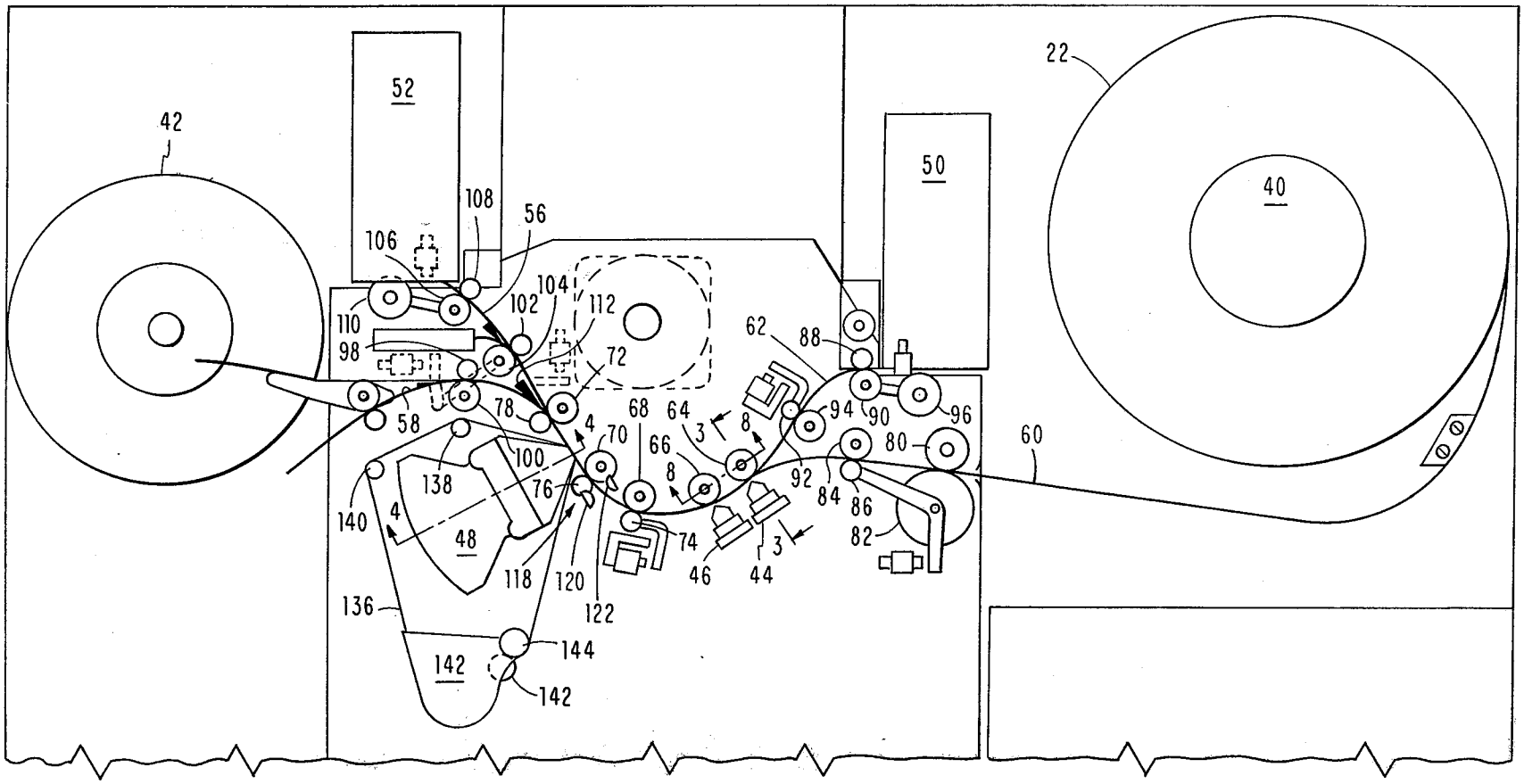
FIG. 2 is a side elevational, schematic view of a ticket handling machine which includes the printing mechanism of the invention.

Referring to FIG. 2, the machine includes a reel 40 for a supply roll of the tickets 20 in connected form, a takeup reel 42 for rolling up tickets that have been encoded and printed after being drawn from the reel 40, a write head 44, a read head 46, a printer 48 that is a part of the printing mechanism of the present invention, a supply hopper 50 for individual tickets 20 and a stacker 52 for individual tickets subsequent to encoding and printing. The machine provides a path 54 for the ticket strip 22 or for individual tickets 20 and also provides paths 56 and 58 connected respectively with the stacker 52 and takeup reel 42 and paths 60 and 62 connected respectively with the supply reel 40 and hopper 50. The path 54 is partially defined by drive rolls 64, 66, 68, 70 and 72 and pressure rolls 74, 76 and 78. The rolls 74, 76 and 78 respectively have pressure nips with rolls 68, 70 and 72. The roll 64 is disposed opposite the write head 44, and the roll 66 is disposed opposite the read head 46.

The path 60 is partially provided by nipped rolls 80 and 82 and nipped rolls 84 and 86. The path 62 is partially provided by nipped rolls 88 and 90 and nipped rolls 92 and 94. A pick roll 96 is moveable through a bottom opening in the hopper 50 for feeding individual tickets 20 one at a time from the bottom of the hopper 50 into the path 62.

The path 58 is partially provided by nipped rolls 98 and 100, and the path 56 is partially provided by nipped rolls 102 and 104 and by nipped rolls 106 and 108. A roll 110 extends through a bottom opening in the stacker 52 for moving individual tickets from path 56 into the bottom of the stacker 52. A ticket deflector 112 is provided for routing the tickets from path 54 either into path 56 or into path 58, depending on whether the tickets 20 are in connected or disconnected relationship to each other.

Figure 3:
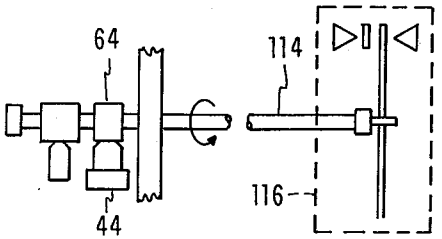
FIG. 3 is sectional view taken on line 3—3 of FIG. 2.

Referring to FIG. 3, the roll 64 is fixed to a shaft 114, and shaft 114 drives an emitter 116. The emitter 116 provides an output pulse for each fraction of a degree of rotation of roll 64 and shaft 114.

A ticket sensor 118 straddles the path 54 adjacent the printer 48 and comprises a lamp 120 (see FIGS. 2 and 14) on one side of the path and a phototransistor 122 on the other side of the path. The lamp 120 is positioned so that its output rays are blocked by means of the stripe 34 of a ticket 20 positioned between lamp 120 and phototransistor 122, and the lamp rays shine through each of the slots 28 as the ticket strip 22 passes between lamp 120 and phototransistor 122. Similarly, the ends of individual tickets 20 allow the rays of lamp 120 to strike phototransistor 122 as the ticket moves in path 54 to printer 48. The center line of the sensor 118 is positioned one inch along path 54 form the center line of printer 48 as viewed in FIG. 2, and the center line of sensor 118 is in alignment with the longitudinal center lines of the stripes 34 as the tickets 20 move along path 54.

Figure 14A:
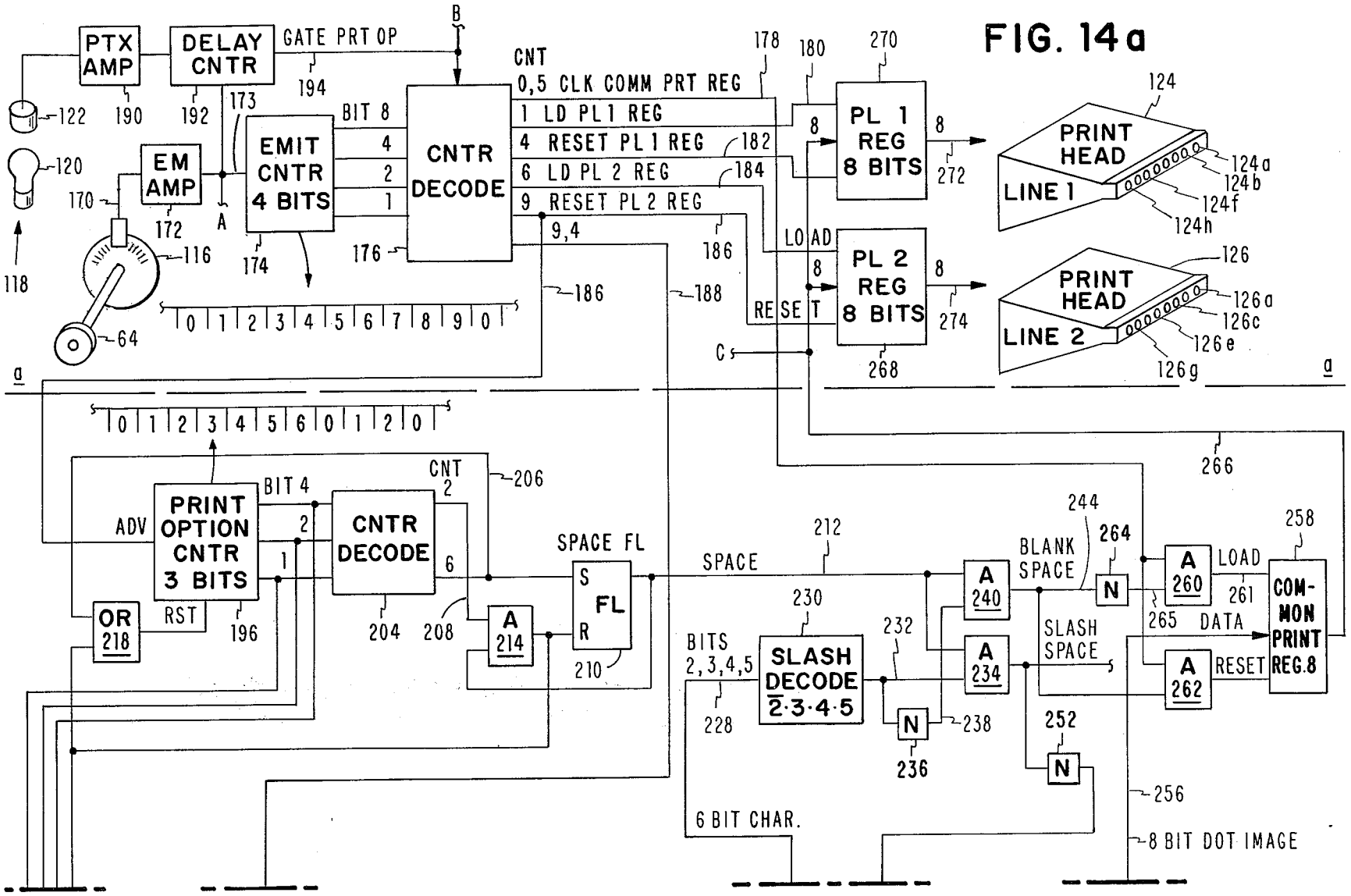
FIG. 14 is a diagram showing how FIGS. 14*a* and 14*b* shall be placed together to form a FIG. 14 electrical circuit for controlling the printing mechanism.
Figures 14, 14B:
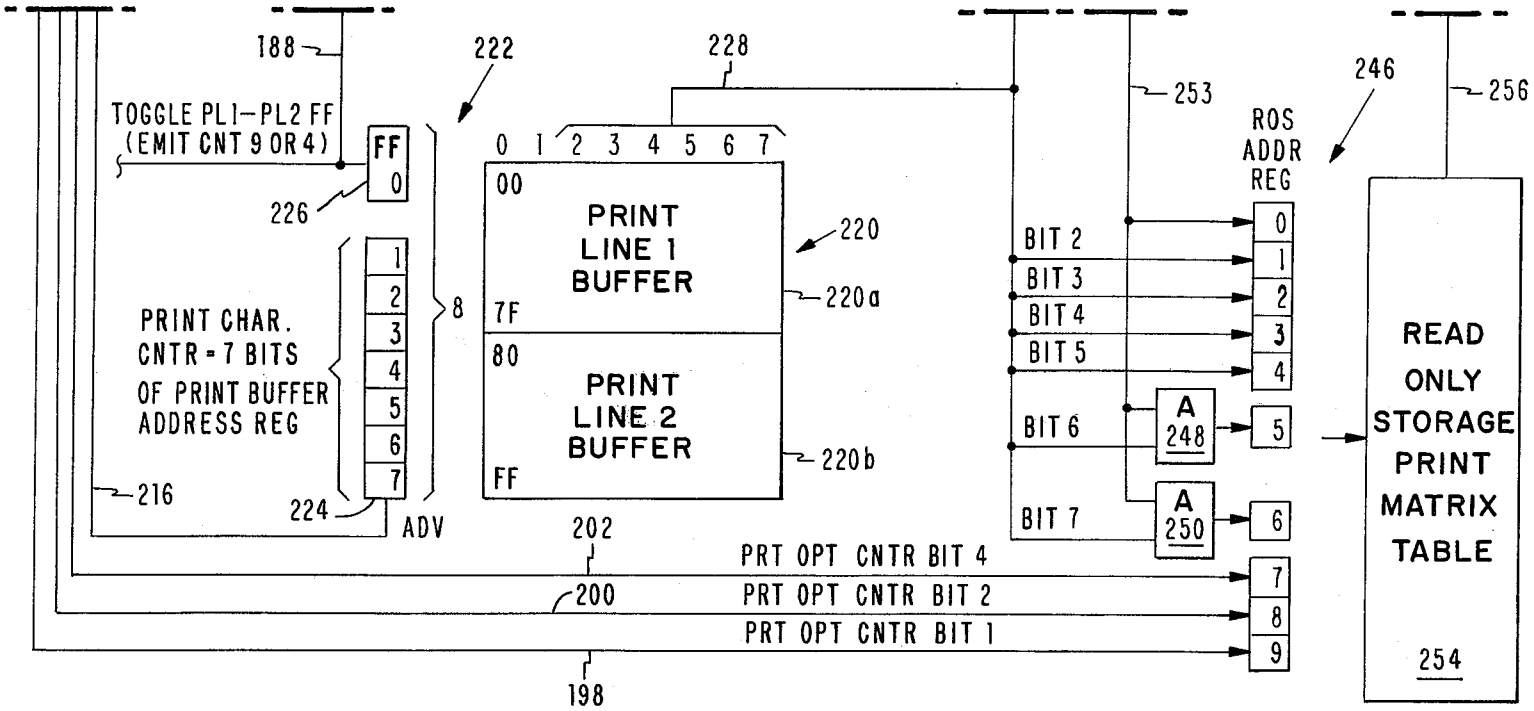

The printer 48 includes two print heads 124 and 126 (see FIG. 14). Each of these heads has a row of eight print wires reciprocably carried by the head. These wires in the print head 124 are the wires **124*a*, 124*b*, 124*c*, 124*d*, 124*e*, 124*f*, 124*g* and 124*h*. The corresponding wires in the print head 126 are the wires 126*a*–126*h*. The row of print wires 124*a*–124*h* in the print head 124 and the row of print wires 126*a*–126*h* in the print head 126 are in alignment, extending transversely across the path 54. The print head 126 is identical with the print head 124; and, therefore, only details of the print head 124** will be described in detail hereafter.

Figure 5:
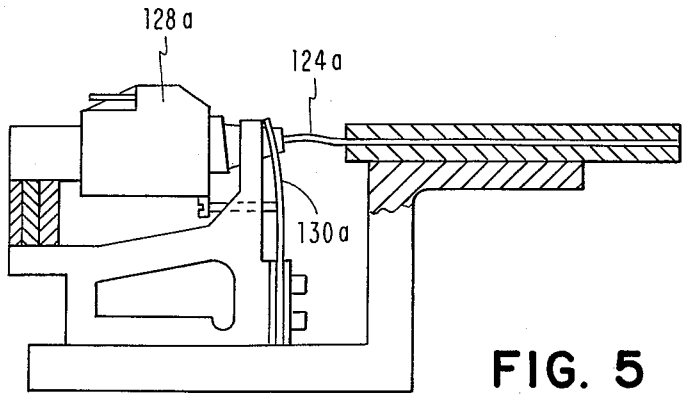
FIGS. 5 and 6 are sectional views through the printing mechanism each showing one of the wires and the electromagnet therefor, with the electromagnet being in different states and with the wire being in different corresponding positions.
Figure 6:
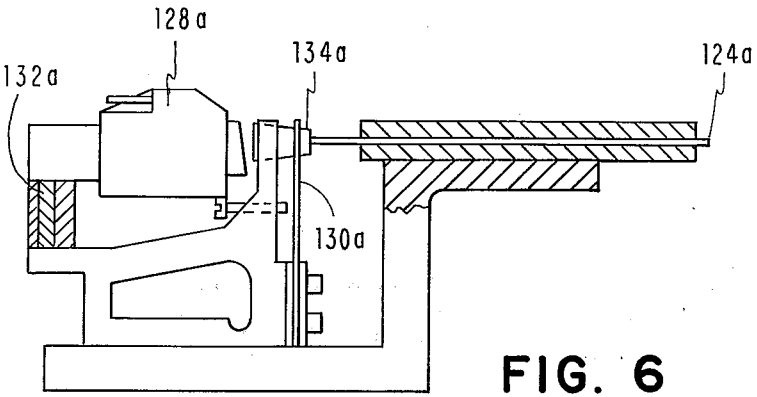

Each of the wires **124*a*–124*h* is actuated by an electromagnet or coil 128 and a leaf spring 130 (see FIGS. 5 and 6). The electromagnet 128*a* and the spring 130*a* for the print wire 124*a* are shown in two different conditions of operation in FIGS. 5 and 6. A permanent magnet 132*a* is provided in connection with the coil 128*a*, and the wire 124*a* is fixed with respect to an armature 134*a* which is drawn inwardly with respect to the electromagnet 128*a* due to the magnetic action of the permanent magnet when the electromagnet 128*a* is in de-energized condition (see FIG. 5). When the electromagnet 128*a* is energized, the electromagnet 128*a* acts as a bucking coil and cancels the magnetic field from the permanent magnet 132*a*, so that the spring 130*a* is effective on the armature 134*a* to move the print wire 124*a* forwardly out of its casing into printing relation with a ticket 20**.

Figure 7:
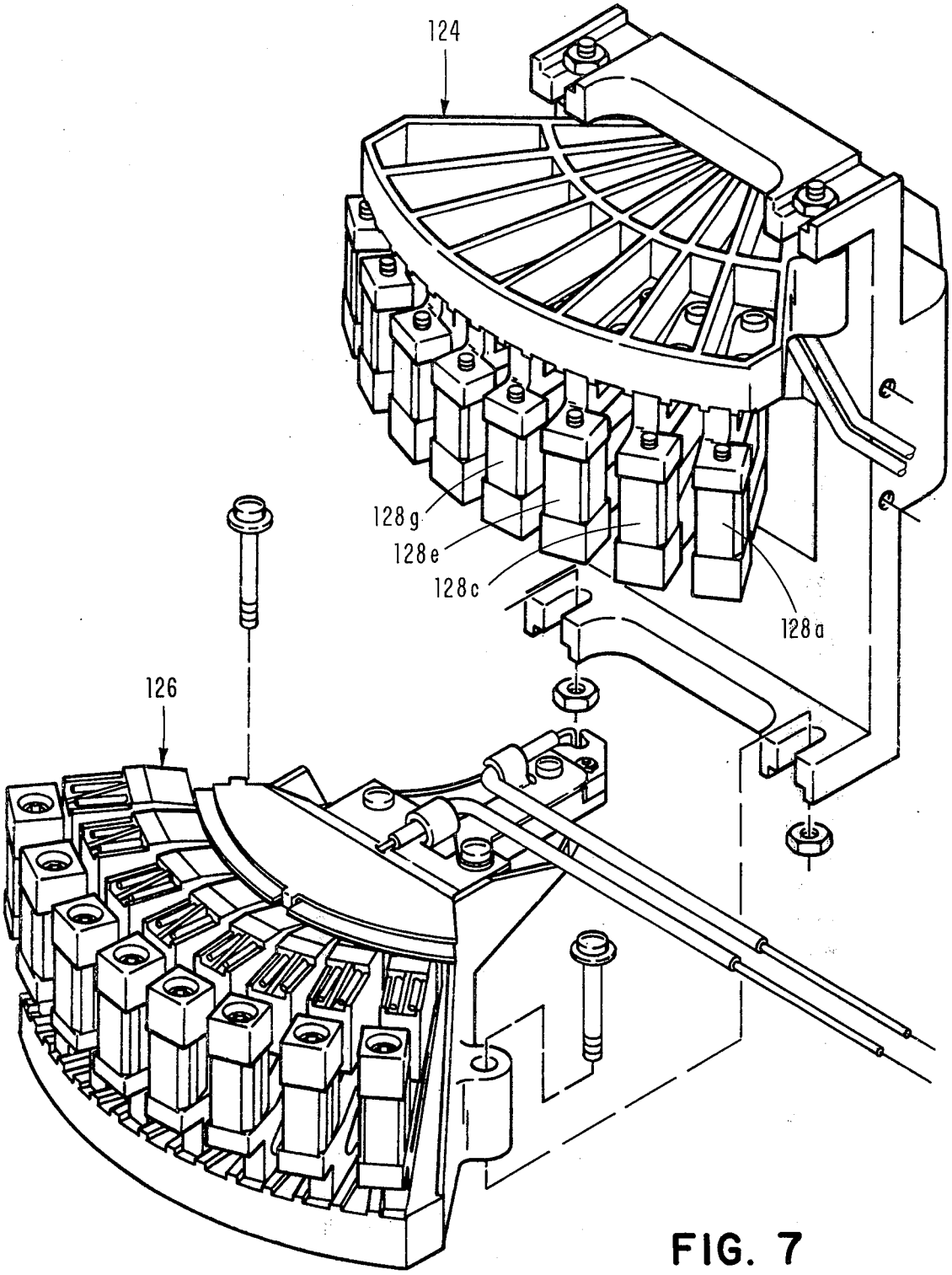
FIG. 7 is a perspective view of the printing mechanism.

The two print heads 124 and 126 are shown in perspective in FIG. 7; and coils **128*a*, 128*c*, 128*e* and 128*g* are indicated in particular. It will be observed that the coils 128*a*–128*g* are disposed in circular array and the wires 124*a*–124*h* are bent and guided accordingly so that the wires 124*a*–124*h* terminate in the row as indicated in the FIG. 14 extending transversely across path 54. The print heat 126** is of similar construction.

An inked print ribbon 136 (see FIG. 2) extends around the printer 48 and particularly over the ends of the print heads 124 and 126 and the wires **124*a*–124*h* and 126*a*–126*h*. The ribbon 136 also extends over idler rolls 138 and 140. The ribbon is contained in a cartridge 142 and is fed into the cartridge by means of a driving roll 144 having a pressure nip with a pressure roll 146. The roll 144 is driven from the same prime mover that drives other rolls in the machine defining the paths 60, 62, 54, 58 and 56**.

In the operation of the machine shown generally in FIG. 2, the tickets 20 in the form of strip 22 may be drawn off of the supply reel 40 and may pass through the paths 60, 54 and 58 to the takeup reel 42. The tickets are propelled in these paths by means of various of the rolls defining the paths which are driven from a suitable prime mover contained in the machine. Thus, various of the rolls 80, 82, 84, 86, 64, 66, 68, etc. may be driven for this purpose; and the movement of the tickets 20 in these paths is at a constant speed. As the tickets 20 pass over the write head 44, their magnetic stripes 34 may be magnetically encoded; and, as the tickets subsequently pass over the read head 46, this magnetic encoding may be read for checking purposes, for example. As the tickets subsequently pass over the printer 48, the tickets may be printed thereby on their print lines 36 and 38, the print heads 124 and 126 being respectively effective for printing on lines 36 and 38. The sensor 118 has its center located one inch away from the center line of the printer 48, viewing these parts as in FIG. 2; and the sensor 118 is activated by a notch 28 between consecutive ones of the tickets 20 and causes the printer 48 to be printing at the proper spots on a ticket 20 passing across the printer 48.

Individual ones of the tickets 20 may also be used in the same manner in the machine. The individual tickets are moved out of the bottom of the hopper 50 by means of the pick roll 96 and move in the path 62 to the encoding head 44 and read head 46 where they are magnetically encoded and read in the same manner as in the case in which the tickets 20 are in the strip 22. An individual ticket then moves through path 54 where its forward end is detected by the sensor 118, causing the printer 48 to be effective for printing this individual ticket in the same manner as previously described in connection with the tickets 20 in the form of strip 22. The individual tickets then move from path 54 to path 56 and into the stacker 52. The ticket deflector 112 is effective for causing the individual tickets 20 to move in the path 56 in lieu of the path 58.

Figure 8:
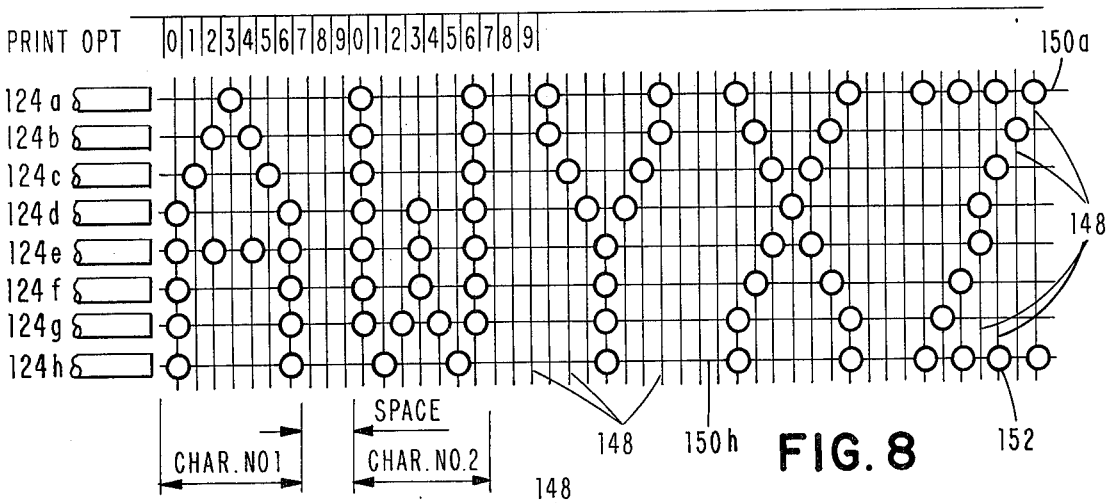
FIGS. 8, 9, 10, 11 and 12 show characters which are capable of being printed by the printing mechanism.

The two print heads 124 and 126 function identically in their printing functions, and each produces the various printed characters shown in FIGS. 8–13, as well as many other printed characters. The characters shown in FIGS. 8–13 are illustrative only. As a ticket 20 passes across the print head 124, the print wires 124*a*–124*h* may print on center lines 148 extending transversely across the ticket. The eight wires 124*a*–124*h* respectively print on eight lines 150*a*–150*h* extending longitudinally of the ticket 20 being printed. The distance between the center lines 148 may, for example, be 0.0083 inch, and the eight print wires 124*a*–124*h* (or wires 126*a*–126*h* for the head 126) may be spaced apart on their centers by 0.015 inch. The diameter of each of the wires, and its printing surface and resultant printed dot 152 on a ticket 20, may be 0.012 inch. It is contemplated that each of the printed characters may be provided by impacts from the wires 124*a*14 124*h* on seven consecutive ones of the transverse center lines 148 and that there shall be preferably three center lines 148 which define a space between consecutive characters. With this format, a full sized A may be provided by the wires 124*a*–124*h* as shown in FIG. 8, with the wires 124*d*–124*h* providing the straight sides of the A and the wires 124*a*–124*c* providing the upper part of this letter. The letter is thus formed by printed dots 152 on each of the seven center lines 148; and, the letter is eight dots 152 high, with one or more dots 152 being on each of the longitudinal center lines 150*a*–150*h*. The succeeding space embraces the three transverse center lines 148 across the ticket 20 following the seven center lines 148 for the letter A, and the second character is shown in FIG. 8 as a W. The succeeding full sized letters in FIG. 8 are shown as Y, X and Z, and each of these letters also utilizes the seven center lines 148 for a character; and a space of three center lines 148 is provided between each of these characters. Each of the center lines 148 constitutes the center of a print option time also shown in FIG. 8, the actual length of which is determined by the speed of the ticket 20 in passing across the printer 48.

Figure 9:
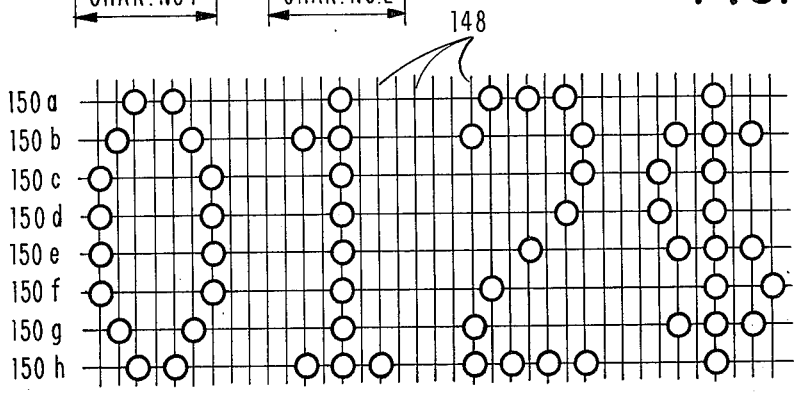

The printer 48 is also capable of printing numerical characters, and three of these are shown as examples in FIG. 9, these being 0, 1 and 2. The printer 48 can also print special characters, such as the dollar sign shown in FIG. 9. Each of these characters has seven of the center lines (and seven of the print option times) devoted to it, with a space of three center lines 148 being set aside for spacing between the characters; although, as will be seen from FIG. 9, the character 1 does not actually require the full seven center lines 148 and seven print option times.

Figure 10:
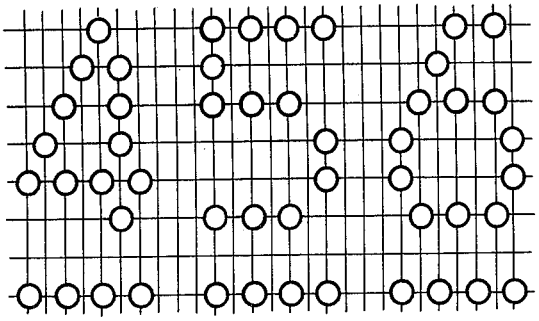

The printer 48 is also capable of providing underscored numeric characters, such as the 4, 5 and 6 illustrated in FIG. 10. In this case, the wires 124*a*–124*f* are used for forming the characters, and each character is six dots 152 high on the longitudinal center lines 150*a*–150*g*. The wire 124*h* is used for forming the underscoring on the line 150*h*. Each of these characters also has seven of the transverse center lines 148 and seven of the print option times set aside for it; and the three succeeding transverse center lines 148 and print option times following a character are set aside for the space between characters. It is apparent from the underscoring in FIG. 10 provided by the print wire 124*h* that the print wire 124*h* is effective only on alternate ones of the center lines 148. In the particular embodiment illustrated, this is due to the fact that the speed of the machine is such that the armatures 134 can only print on alternate ones of the center lines 148 and cannot move fast enough to print on successive center lines 148. The diameter of the wires 124 is, however, sufficiently large so that easily recognizable characters are produced with this limitation.

Figure 11:
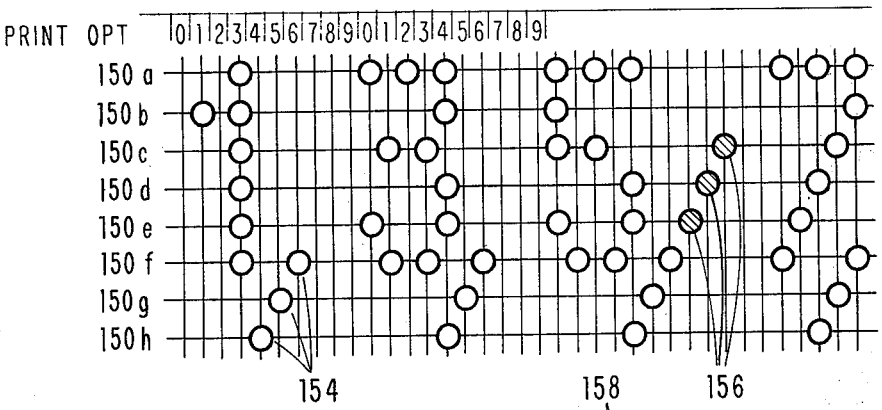

The printer 48 is also capable of producing fractions requiring only the space lengthwise of a ticket 20 set aside for two numerals (seven center lines 148 for the first numeral, three center lines for the following space and seven center lines for the second numeral, or 17 center lines 148 in all), and this is considered an important feature of the invention. The numerators 1, 3, 5 and 7 are shown in FIG. 11; and it will be observed that, as for the numerals of FIG. 10, only the upper six wires 124*a*–124*f* are used for the numerals (effective for printing dots 152 on only the longitudinal lines 150*a*–150*f*). In the seven center lines 148 and the seven print option times set aside for each numeral, each character also has and includes the lower portion 154 of a slash mark, this being provided by the print wires 124*h*, 124*g* and 124*f* acting successively on the last three of the seven center lines 148 of the character and printing dots on the longitudinal lines 150*h*, 150*g* and 150*f*. The lower slash portions 154 for each of the numerators 1, 3, 5 and 7 are all illustrated in FIG. 11.

The printer 48 may be effective for providing the intermediate slash portion 156 of a printed fraction by utilizing the space having three center lines 148 set aside for it between successive characters, and this intermediate slash portion 156 is also illustrated in FIG. 11. The wires 124*c*, 124*d* and 124*e* are used for providing the intermediate slash portion 156, with the wires 124*e*, 124*d* and 124*c* being effective on succeeding ones of the center lines 148 for printing dots 152 on lines 150*c*, 150*d* and 150*e* as shown in FIG. 11.

Noting FIG. 11, easily readable fractions are obtained by causing the lowermost slash portion 154 to use the last three center lines 148 of the seven set aside for a character, these three center lines being on the right side of the character, while forming the digit of the numerator by utilizing less than all seven of the center lines 148 and utilizing those on the beginning part of the character. For example, the numerator 3 utilizes the first five of the seven center lines 148 for the digit while the initial portion 154 of the slash utilizes the last three of the seven center lines provided for the character.

Figure 12:
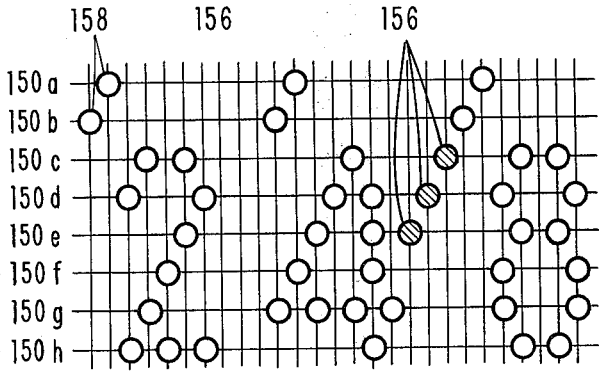

The denominators of the fractions printed by the printer 48 are illustrated in FIG. 12, these being the denominators 2, 4 and 8 in particular. The numerals of the denominators are provided by the lowermost six wires 124*c*–124*h* effective to print dots 152 on lines 150*c*–150*h*; and, when the shape of the numeral allows, less than all of the seven center lines 148 for for the character are used for the numeral. In all cases, the numeral is placed on the right side of the space set aside for the character and utilizes the last or seventh center line 148 for the character. The numeral 2 in FIG. 12, for example, utilizes only the last five of the seven center lines 148 set aside for the character.

Each of the denominators includes the final portion 158 of the slash in the fraction, and this is provided by wires 124*b* and 124*a* which print successively on the first and second center lines 148 of the seven center lines 148 and on the longitudinal lines 150*b* and 150*a*. The intermediate portion 156 of the slash for a fraction is also illustrated between the numerals 4 and 8 of FIG. 12; and, as previously described, this slash portion is provided by the print wires 124*3*, 124*d* and 124*c* acting successively on succeeding center lines 148 of three center lines 148 set aside for a space between characters.

Figure 13:
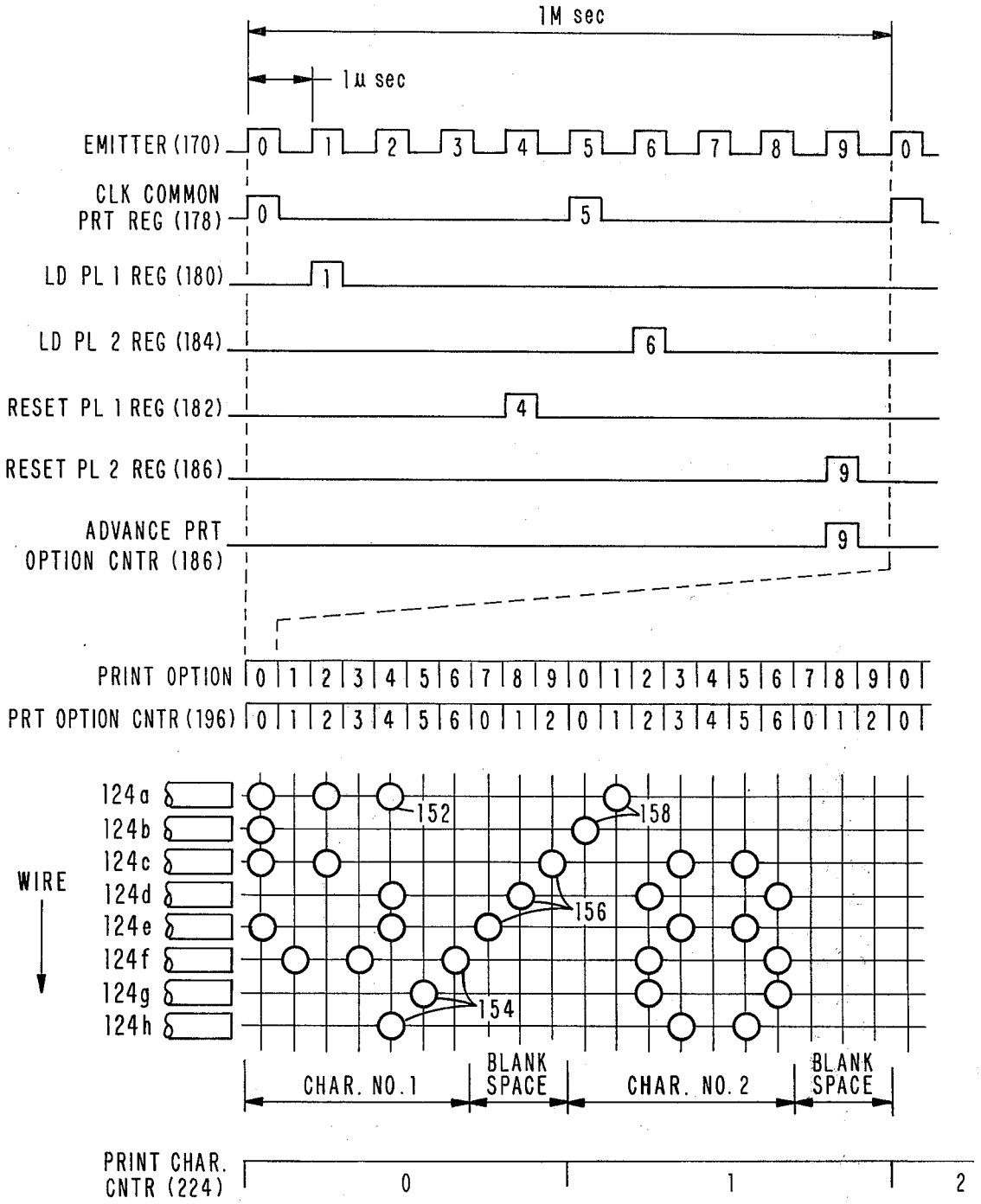
FIG. 13 is a diagram showing print option timing of the printing mechanism and a fraction printed by the printing mechanism.

The completed fraction ⅝ as provided by printer 48 is shown in FIG. 13, using the numerator 5 as shown in FIG. 11 and the denominator 8 as shown in FIG. 12. The initial slash portion 154 is provided along with the numerator 5 as previously described; the intermediate slash portion 156 is provided by the print wires 124*e*, 124*d* and 124*c* printing successively on longitudinal lines 150*e*, 150*d* and 150*c* and on the three succeeding center lines 148 set aside for a space, and the final portion 158 is provided along with the denominator as previously described. As is apparent from FIG. 13, in particular, it is thus possible for the printer 48 to provide a fraction utilizing only the two sets of center lines 148 for the two characters and the three center lines 148 set aside for a space between succeeding characters or seventeen center lines 148 in all. It will be noted that the three slash portions 154, 156 and 158 form a straight diagonal line providing an easily readable fraction.

Circuitry for performing the printing functions just described is shown in FIG. 14. The circuitry is partially under control of the emitter 116 which produces an emitter signal on line 170 constituting clock pulses which occur every 100 microseconds. The rotatable portion of emitter 116 is connected with roll 64, and the frequency of the clock pulses on line 170 is thus proportional to the speed of travel of the tickets 20 through the machine. The frequency of pulses at the 100 microsends spacing is based on a velocity of the tickets 20 through the machine of 8.33 inches per second.

The output of the emitter 116 is applied by means of line 170 onto emitter amplifier 172 and through line 173 on emitter pulse counter 174. Counter 174 is of a free-running type, counts from 0 through 9 in binary and wraps around on every tenth pulse from emitter 116. The output of counter 174 is on 1, 2, 4 and 8 bit lines by means of which the output of counter 174 is applied to a counter decode 176.

The decode 176 produces the "clock common print register" signal on line 178, the "load PL1 register" signal on line 180, the "reset PL1 register" signal on line 182, the "load PL2 register" signal on line 184, the reset PL2 register and "advance print option counter" signals on line 186 and the "toggle PL1-PL2 flip flop" signal on line 188.

The FIG. 14 circuitry is also under control of the sensor 118 which is connected through a phototransistor amplifier 190 to a delay counter 192. Counter 192 produces the signal "gate print operation" on line 194 which constitutes an input to decode 176. The emitter pulse output on line 170 is shown in FIG. 13, and the decode 176 is of such construction that it makes the following transfers: the nos. 0 and 5 emitter pulses to line 178, the no. 1 emitter pulse to line 180, the no. 6 emitter pulse to line 184, the no. 4 emitter pulse to line 182 and the no. 9 emitter pulse to line 186. Since the time spacing between successive emitter pulses is 100 microseconds, the full counting action of counter 174 requires 1 millisecond; and the time spacing of the various pulses on the lines 178, 180, 182, 184 and 186 is shown in FIG. 13. As is indicated in FIG. 13, one print option time is one millisecond, and all of the 0 to 9 emitter pulses occur on the output lines of counter decode 176 within the same 1 millisecond. The counter 192 is constructed to provide its output signal gate print operation on line 194 only after a predetermined number of counts that correspond with the time between the blockage by the leading end of a ticket 20 of light from lamp 120 to phototransistor 122 and the time at which the printer 48 should start printing on a ticket 20. The counter decode 176 is overcontrolled by the gate print operation signal on line 184 so that the output signals on lines 178, 180, 182, 184 and 186 as previously described being only after the rise of the gate print operation signal on line 194.

The line 186 is connected to the "advance" terminal of a print option counter 196. The counter 196 counts in binary and provides "print option counter bit" 1, 2 and 4 signals on lines 198, 200 and 202. The lines 198, 200 and 202 provide inputs to a counter decode 204 which is of such construction that it provides an output on a line 206 after counts from 0 through 6 in counter 196 and provides an output on line 208 after counts from 0 through 2 in counter 196. Line 206 is connected to the set terminal of a "space flip latch" 210 having an output line 212. An AND circuit 214 has the lines 208 and 212 as inputs and has an output line 216. An OR circuit 218 has the lines 216 and 206 as inputs and has its output connected to the reset terminal of the print option counter 196.

The effect of this arrangement of counter 196, decode 204, AND circuit 214, OR circuit 218 and flip latch 210 is to cause the counter 196 to first count from 0 through 6 and then from 0 through 2, providing corresponding outputs on lines 198, 200 and 202. The first output of decode 204 (on line 206) causes the counter 196 to be reset when the count in counter 196 equals 6, and the latch 210 is set at this time. The AND circuit 214 is satisfied when subsequently the count of counter 196 equals 2 so as to provide an output signal on line 216 resetting both the counter 196 and the latch 210.

Incidentally, the counts of 0 through 6 of counter 196 are the seven character option times, and the subsequent counts of 0 through 2 of counter 196 are the three blank space of slash space option times, all previously referred to. The seven plus 3 option times are repeated for each character and a character plus space time is 10 milliseconds. The AND circuit 214 is so connected with the decode 204 and flip latch 210 so that a pulse occurs on its output line 216 at the end of each character plus space time or 10 milliseconds.

The data to be printed on a ticket 20 has been previously stored in a print character buffer 220 having upper and lower halves 220*a* and 220*b*. The upper buffer half 220*a* contains the data for the print line 36, and the lower buffer half 220*b* contains the data for the lower print line 38. The print character buffer 220 has an 8 bit address register 222. The lower order 7 bits of register 222 constitute a 7 bit counter 224, and the highest order bit of register 222 constitutes a flip flop 226. The 7 bit counter 224 has its advance terminal connected with the line 216 that is pulsed every 10 milliseconds, at the end of each character plus space time; and counter 224 thus is incremented every 10 milliseconds. The flip flop 226 is connected to line 188 having emitter counts 4 and 9 thereon, and the flip flop 226 thus is toggled by each of these emitter counts. This action of the flip flop 226 has the effect of dividing each millisecond of print option time into 2½ millisecond intervals; and, as will appear hereafter, the first half millisecond is used to option print head 124 and the second half millisecond is used to option print head 126 for printing action.

The output of buffer 220 (from its bit positions 2, 3, 4, 5, 6 and 7) is on a bus 228, and bus 228 applies the contents of bit positions 2, 3, 4 and 5 of buffer 220 onto a slash decode circuit 230. Decode 230 is of such construction that it provides an output signal on its output lead 232 when there are bits in bit positions 3, 4 and 5 and no bit in bit position 2 of buffer 220. Lead 232 is connected to AND circuit 234 and to an inverter 236. The output of inverter 236 is on lead 238 which constitutes an input to an AND circuit 240. The lead 212 constitutes inputs both AND circuits 234 and 240, as shown. The outputs of AND circuits 234 and 240 are respectively the signals "slash space" on line 242 and "blank space" on line 244.

The bus 228 also applies the contents of bit positions 2, 3, 4 and 5 in buffer 220 to a read only store address register 246 and in particular to the 1, 2, 3 and 4 positions of register 246. In addition, the content of bit positions 6 and 7 in buffer 220 are applied to the 5 and 6 positions of address register 246 respectively through AND circuits 248 and 250. An inverter 252 is connected to lead 242 and supplies its output by means of lead 253 to AND circuits 248 and 250 and also to the high order 0 position of the address register 246. The lowest order 3 bits of the address register 246 are the three output bit signals of the print option counter 196 supplied through leads 198, 200 and 202.

A "space" signal exists on line 212 when the space portion of a ticket 20 is beneath the wires 124*a –h* and 126*a–h*; and this signal, in addition to the output of the slash decode 230, controls the highest order bit of the ROS address register 246 by means of the AND circuit 234, inverter 252 and the output of inverter 252 on line 253. This signal on line 253 also forces bits 5 and 6 of the ROS address register 246 to 0, utilizing the AND circuits 248 and 250.

The address register 246 controls a read only store 254 containing 8 bit bytes representing the dot images of characters to be printed. Thus, as will appear more fully from a following description of operation, for each print character as specified by bits 1, 2, 3, 4, 5 and 6 of ROS address register 246 and for each print option time as specified by ROS address register bits 7, 8 and 9; an 8 bit byte representing the dot image of a character at that option time is selected out of the read only store 254.

The read only store 254 is outputted through a bus 256 which carries an 8 bit dot image signal, and this signal is loaded into a common register 258 by means of the bus. The print register 258 is controlled by AND circuit 260 having output line 261 and by AND circuit 262. The line 244 carrying the blank space signal is applied to AND circuit 262 as an input, and the inverse of the "blank space signal" is applied to the AND circuit 260 by means of the inverter 264 to which line 244 is applied as an input. The output of inverter 264 is applied through lead 265. The line 178 carrying the signal "clock common print register" is also applied onto both of the AND circuits 260 and 262. A signal from AND circuit 260 causes data on bus 256 to be loaded into register 258, and a signal from AND circuit 262 resets register 258.

The common print register 258 has its output applied to a bus 266 by means of which the content of the register 258 is supplied to a PL2 register 268 and a PL1 register 270. The lines 180 and 182 respectively carrying the signals load PL1 register and reset PL1 register are also applied onto register 270, and the lines 184 and 186 respectively carrying the signals load PL2 register and reset PL2 register are also applied onto the register 268. The output of the register 270 is on a bus 272 connected to print head 124, and the output of register 268 is on a bus 274 connected with print head 126.

The content of the read only store 254 is shown in FIG. 15 and includes three tables I, II and III. The three tables are selected by the highest two order bits in address register 246. When bits 0 and 1 address register 246 are 1 and 0 respectively, table I is selected; when these two bits are respectively 1 and 1, table II is selected; and when both of these bits are 0, table III is selected. Biits 2, 3, 4 and 5 in address register 246 select one of the 16 horizontal rows of bits in either table I or table II; and bits 6, 7, 8 and 9 in address register 246 select a particular column of the 16 columns of tables I and II. Thus, by combinations of the bits in address register 246, it is possible to select the content of any of the sub-areas 276 in store 254 formed by the crossings of the rows and columns of the tables I and II, and it is also possible to select any of the three sub-areas 276 in Table III.

Each of the sub-areas 276 in read only store 254 contains a byte of 8 bits. These bits correspond to the 8 print wires, for example the print wires 124*a*, 124*b*, 124*c*, 124*d*, 124*e*, 124*f*, 124*g* and 124*h* of print head 124. If bits 0, 1, 2, 3, 4, 5 and 6 of the 8 bit byte are on, print wires 124*a*, 124*b*, 124*c*, 124*d*, 124*e*, 124*f* and 124*g* will each be effective to print a corresponding dot 152 on the ticket 20. This is the case for print option time 0 when the letter W as shown in FIG. 8 is being printed. This particular byte is located in Table II in the sub-area 276 at the junction of row 3 and column 0 and is indicated by $W_0$. At the next print option time (No. 1), the content of the next sub-area in this row indicated by $W_1$ is used. In this byte, only the eighth bit is on; and this causes a printing action by only the wire 124*h*. At the next print option time 2 in printing the letter W, the content of the next sub-area 276 in this row and indicated by $W_2$ is used. This sub-area has only the seventh bit on, and this causes a printing action by only the wire 124*g*. The content of the next sub-area 276 labelled $W_3$ is used at the next print option time 3; and the byte in this sub-area has bits 4, 5 and 6 on. This causes the printing action by print wires 124*d*, 124*e* and 124*f*, providing the central portion of the W character as shown in FIG. 8. Likewise, the sub-areas $W_4'$, $W_5$ and $W_6$ have the data therein for the printing action by the wires in print option times 4, 5 and 6.

As another example, the sub-areas 276 in columns 8, 9, A, B, C, D and E in row E of Table II are used for obtaining the printing information for the denominator 2 as shown in FIG. 12. At the 0 print option time, the content of the sub-area 276 in column 8 is used, and this is a byte having only bit 1 on. This causes a printing action by only the wire 124*b*. The content of the sub-area 276 in row 9 is used at the next print option time 1, and the byte in this location has only the 0 bit on, causing a printing action by only the wire 124*a*. At the next print option time 2, the content of the sub-area 276 in row A is used; and the byte at this location has bits 3 and 7 on, causing a printing action by the wires 124*d* and 124*h*. Correspondingly, the byte contents of columns B, C, D and E in row E of Table II are used for the printing action by the wires in the remaining print option times 3, 4, 5 and 6, causing the proper wires 124*a* to 124*h* to have a printing action and providing the dots 152 for the denominator 2 as shown in FIG. 12.

Only three of the sub-areas 276 are used in Table III, these being selected when bits 0 and 1 of address register 246 are both 0 and when bits 2, 3, 4 and 5 of register 246 indicate hexidecimal E. The three sub-areas 276 in Table III correspond with the three dots 152 in the intermediate slash portion 156. /0 in column 0 of Table III has only the bit 4 of the 8 bit byte on, and this causes a printing action by the wire 124*e* which provides the first printed dot 152 for print option 7 (see FIG. 13) subsequent to the 0–6 print option times for a full character. The second sub-area 276, /1, has only the third bit on, and this causes the print wire 124*d* to be effective in print option time 8, providing the dot 152 at this print option time indicated in FIG. 13. The next sub-area 276, /3, in column 2 of Table III is used for the next print option time 9, and the byte of information at this place has only the second bit on so that only the wire 124*c* is effective at this print option time, completing the intermediate slash portion 156.

The FIG. 14 circuitry, in operation, relies on the pulses from emitter 116 on line 170 for its continued operation. The emitter 116, by means of the amplifier 172, counter 174 and decode 176 produces the previously mentioned timing pulses on lines 178, 180, 182, 184, 186 and 188; however, these timing pulses do not begin until a predetermined count has taken place in counter 192 subsequent to the passage of the leading end of a ticket 20 through sensor 118. Thereafter, at print option time 0, a first printing action by the heads 124 and 126 along the first transverse line 148 extending across the ticket 20 will take place as follows:

With the print option time (see FIG. 13) being 0, the print option counter 196 contains a 0 count. Counts 4 and 9 in the first millisecond of operation have, of course, not been reached; and therefore the flip flop 222 which is subject to the signal on line 188 occurring in pulse form on counts 9 and 4, is in its 0 count condition. Likewise, the print character counter 224 is in its 0 count condition. The buffer address register 222 under these conditions points at the 0 position of the print line buffer 220, particularly in the buffer portion 220*a* for the print head 124. The first character to be printed by the print head 124 is thus available at this time in 6 bit form on bus 228.

There is no "slash space" signal on line 242 at this time, and the inverter 252 thus produces an up signal level on line 253. The AND circuits 248 and 250 are thus enabled for the passage of either bit 6 or bit 7 through them from bus 228, and a 1 is applied to the 0 position of the ROS address register 246. Referring to FIG. 15, the 1 applied to the 0 position of the ROS address register 246 causes the output of the address register 246 to be contained in Table I or Table II but not in Table III. For the purpose of illustration, it will be assumed that the print line 1 buffer portion 220*a* contains the bit representation of an A in its 0 position, this being 000001 and present on bus 228; and these signals are applied respectively on the 1, 2, 3, 4, 5 and 6 positions of the ROS address register 246. Initially, the contents of the 7, 8 and 9 positions of the ROS address register 246 are 0, since counter 196 has its outputs applied to these positions and has zero content. Referring to FIG. 15, it will be observed that a 0 in the 1 position of the ROS address register 246 causes Table I to be the table being considered. The 2, 3, 4 and 5 positions of the ROS address register 246 determine the horizontal rows in Table I to be considered, these being indicated by the ordinates 0 to F in hexadecimal. The vertical columns to be considered are determined by the bits 6, 7, 8, and 9 in the address register 246, and the designations of the columns, 0 to F, are also in hexadecimal. The 0's in all of positions 2, 3, 4, and 5 of address register 246 indicate that the contents of the (0) horizontal row are to be considered. Since only the sixth position of register 246 contains a 1, with the remaining 7, 8 and 9 positions of this register containing 0's, the contents of the column 8 are thereby indicated and are to be considered. Thus, in particular, the contents of the 0 row and column 8 in Table I are considered at this time, and the 8 bit dot image contained in the $A_0$ sub-area 276 (00011111) of the FIG. 15 matrix table is present at this time on the bus 256. Bits 3, 4, 5, 6 and 7 corresponding to print wires 124*d*–124*h* are thus raised on bus 256 for print option time 0 for letter A.

This 8 bit dot image, as data, is fed into the common print register 258 from the bus 256. The inverter 264, at this time, has no input; and it therefore produces a 1 on its output line 265 applied to AND circuit 260. At the count 0 pulse on line 178 also applied, AND circuit 260 produces a load pulse on line 261, causing the 8 bit dot image from bus 256 to be moved into the common print register 258.

This content of the common print register 258 is loaded into the PL1 register 270 at the succeeding count 1 pulse on line 180, and this content of the PL1 register 270 is applied through the bus 272 to the print head 124. Wires 124*a*–124*h* are thus moved into printing contact with the ticket 20 on its upper print line 36, producing a printed dot 152 for each of these wires. Printing at this time takes place on the first transverse line 148 across the ticket 20 in print lines 36. Thus, the lefthand edge of the letter A has been produced, made up of the five dots 152 in print option time 0 as shown in FIG. 8.

The PL1 register 270 is reset at count 4 in the first print option time 0 by the reset PL1 register signal on line 182.

At this same count, count 4 in print option time 0, the "toggle PL1→PL2 FF" signal on line 188 raises, and this causes the flip flop 226 of the address register 222 to be set. Under this condition, the address register 222 directs its attention to the lower portion of the buffer 220, namely the print line 2 buffer portion 220*b*. Otherwise, the address register 222 is still in its 0 condition, and the address register 222 is therefore particularly directed to the 0 position of the print line 2 buffer portion 220*b*. Under these conditons, the output of the buffer 220 on its 2, 3, 4, 5, 6, and 7 output positions is the 6 bit character which is contained in the 0 position of the print line 2 buffer portion 220*b*.

For the purpose of illustration, it will be assumed that the 0 position of the print line 2 buffer portion 220*b* contains a bit representation of the 5 character shown as the middle character in FIG. 10. The signal on line 253 remains up, and the 0 position in the ROS address register 246 thus still contains a 1. Likewise, the AND circuits 248 and 250 are enabled with respect to bits 6 and 7 on bus 228. The 1 position in the ROS address register at this time contains a 1, and Table II in FIG. 15 is thus selected. The bit positions 2, 3, 4 and 5 in the ROS address register 246 contain the bits 0101 so that the fifth horizontal row of Table II is thereby selected. The bit in position 6 of the address register 246 is a 0 and likewise, the contents of the 7, 8 and 9 positions of the address register 246 are 0's. Therefore, the first column of the FIG. 15 matrix table is selected, and, the sub-area 276 in the fifth row and first column of Table II has its 8 bit dot image applied to the bus 256. This 8 bit dot image is 11100101; and bit 0, 1, 2, 5 and 7 are raised, corresponding to print wires 124*a*, 124*b*, 124*c*, 124*f* and 124*h* this being for print option time 0 for the character 5. This dot image (11100101) is supplied through the bus 256 into the common print register 258 and is loaded at the fifth emitter count of print option time 0 under the control of the AND circuit 260, similarly as the register 258 was previously loaded for print line 36 at the 0 emitter count of the 0 print option time. This content of the print register 258 is applied to the PL2 register, and this 8 bit signal is loaded into the PL2 register at emitter count 6 of the 0 print option time (see FIG. 13), and the signal is then applied to the lower print head 126. Wires 126*a*, 126*b*, 126*c*, 126*f* and 126*h* are thus fired, producing a corresponding dot in the lower print line 38 of the ticket 20, this being at the first transverse printing line 148 on the ticket 20 in the lower print area 38. The PL2 register 268 is reset by the reset signal on lead 186 at emitter clock 9 of print option time 0 as may be seen from FIG. 13.

At the same emitter clock 9 of print option time 0, the signal on line 186 advances the print option counter 196 to contain a count of 1; and the 1 signal then exists on line 198, providing a 1 content at the 9 position of the ROS address register 246. At this same count of 9, the flip flop 226 of the address register 222 is toggled back into its 0 condition by the signal on line 188 so that the address register 222 again points to the 0 position of the print line 1 buffer portion 220*a*. The bit content of the 0 position of the print line 1 buffer portion 220*a* then again appears on the bus 220, applying these bits into the corresponding ones of the ROS address register 246. Since the 9 position of the address register 246 now contains a 1, the address register 246 now points to the ninth column of the 0 row in Table I of the FIG. 15 matrix table. The sub-area 276 at row 0 and column 9 of Table I contains the bit representation A, (00100000) corresponding to the wire 124*c* for the second transverse print line 148 of the letter A as seen in FIG. 8. This is at print option time 1; and this bit representation (0010000) is passed through the bus 256, the common print register 258, the bus 266, the PL1 register 270 and the bus 272 to the print head 124, similarly as was the case for the wires 124*d*–124*h* which printed on the first transverse print line 148 for print option time 0. Thus the second portion of the letter A on print line 36 for print option time 1 is completed by the action of the print wire 124*c*.

With the completion of the second printing action by the print wire 124*c* on the letter A in print line 36, the flip flop 226 is toggled at emitter count 4 of print option time 1. The address register 222 then points to the print line 2 buffer portion 220*b*, so that the bit representation of the number 5 again appears on the bus 228. This bit representation iis applied onto the ROS address register 246; and, since the 9 position of the address register 246 has a 1 therein, address register 246 points to column 1 of row 5 of Table II in lieu of column 0, row 5, Table II. The bit representation for the second printing action for the character 5 thus appears on bus 256, and the 8 bit dot image on this bus at this time is all 0's. Therefore, there is no printing action by the head 126 for the second transverse print line 148 for the character 5.

The subsequent printing actions by the print head 124 continue in the same manner as for the first two printing actions, in order to provide a printed representation of the letter A on a ticket 20. The ROS address register 246 points successively to the columns A, B, C, D and E of row 0, Table I of FIG. 15; and the ROS address register 246 is advanced in this manner due to the increasing output of the print option counter 196 that is advanced for each emitter clock 9. Likewise, alternating with the printing action for print head 124, the additional printing actions for the character 5 occur, with the ROS address register 246 successively pointing to columns 2, 3, 4, 5 and 6, row 5, Table II of the FIG. 15 matrix table. Print line buffer 220 alternately provides outputs for the A and 5 characters in the successive print option times.

The printing of the first two characters in print lines 36 and 38 on a first ticket 20 is thus completed, utilizing print option times 0, 1, 2, 3, 4, 5 and 6. At emitter count 9 of print option time 6, the print option counter 196 is advanced; and decode 204 at this time produces a signal on its output lead 206 which resets the print option counter 196 to 0 by means or OR circuit 218. This signal on line 206 also sets flip latch 210 so as to provide a space signal on line 212. Except under unusual conditions (to be hereinafter described), a blank space between successive characters is appropriate; and AND circuit 240 thus provides a blank space signal on line 244. Inverter 264 then provides a 0 on its output lead 265 so as to disenable AND circuit 260, and no more data can under these conditions be loaded into the common print register 258. The blank space signal on line 244 also causes the common print register 258 to be reset at count 0 (due to the signal on line 178) of print option time 7 and stay in reset condition, utilizing the AND circuit 262. Thus, for print option time 7 (see FIG. 13), no printing by heads 124 and 126 occurs.

A no printing action by the print heads 124 and 126 occurs for the same reasons for print option times 8 and 9. Thus a space for the three print option times 7, 8 and 9 is provided by the printer just following the first characters printed which, in the specific example given, where A and 5 in print lines 36 and 38. Subsequent to counts 0, 1 and 2, of the print option counter 196 occurring at the ninth emitter count on line 170 in print option time 9 (see FIG. 13), decode 204 provides a signal on line 208. AND circuit 214 is then effective to provide a signal on line 216 which is applied to flip latch 210 to reset this latch. The signal on line 216 is also applied through OR circuit 218 on the reset terminal of counter 196 for resetting counter 196.

The signal on line 216 is also applied onto the print character counter 224, and this signal advances the counter 224 by 1. The print buffer address register 222, then points at position 1 of buffer portion 220*a* and position 1 of buffer portion 220*b*, depending upon the state of the flip flop 226. Printing action for the second and subsequent characters of both print lines 36 and 38 then proceeds, the same as occurred for the first characters of these print lines.

If the next two characters to be printed out of print line buffer portion 220*a*, for example, are the two characters making up a fraction; the 6 bit output of the buffer portion 220*a* for the first of the two characters is 011100, 011110, 011101 or 011111. These bits will have the effect respectively of selecting in Table I (FIG. 15), column 1 and row E, column 1 and row F, column 8 and row E or column 8 and row F. As will be observed from FIG. 15, these sub-areas in Table I contain respectively the printing bits for the characters 1/, 5/, 3/ and 7/, all of which are the numerators in a fraction to be printed.

The numerators shown in FIG. 11 will then be printed by the print head 124 in the same manner in which the other characters are printed as above described, with the print wires 124a-124h being effective in the various print option times shown in FIG. 11. It will be observed from FIG. 11 that all of the seven print option times for characters are utilized for all of these numerators except for the numerator 1 in which the printing action begins at print option time 1. In the cases of all of these numerators, the last dot of the initial slash portion 154 is on the transverse print line 148 within the seventh print option time (print option 6). The numerator 5/ may be considered, for example, as seen in FIG. 13. For this character, bits 0, 1, 2 and 4 are raised initially on bus 256 causing the wires 124*a*, 124*b*, 124*c* and 124*e* to print initially at print option time 0. Corresponding bits are raised on bus 256 for the other print option times including bits 7 and 6 alone for print option times 5 and 6 for completing the initial slash portion 154.

As will be noted from the bit patterns above given for the numerators are provided by buffer portion 220*a*, the 2, 3, 4 and 5 outputs of buffer portion 220*a* are 0111 for all of the numerators which has the effect of locating the E and F rows, either column 1 or column 8, in Table I of FIG. 15. This particular bit pattern, 0111, derived from the exact locations of the numerator printing bits in the FIG. 15 matrix table is used by the FIG. 14 circuitry for indicating that a slash space exists for the space just following the printed numerators shown in FIG. 11. This is accomplished by the slash decode 230 which, when the first 4 bits outputted by the buffer 220 are 0111, provides a signal on lead 232. A space signal exists at this time on lead 212, as well as at all other times just following the printing of a character, as has been previously explained; and AND circuit 234 thus has its inputs satisfied at this time, producing a slash space signal on line 242. Inverter 252 at this time, therefore, provides a 0 signal on line 253, so that a 0 exists in the 0 position of the ROS address register 246. This has the effect of selecting Table III of FIG. 15, as will be apparent from an inspection of FIG. 15. The 0 signal on line 253 also has the effect of disenabling AND circuits 248 and 250, so that no bits 6 and 7 can be applied to the 5 and 6 positions of the ROS address register 246. The 2, 3, 4 and 5 bits of 0111 applied to the 1, 2, 3 and 4 positions of the ROS address register 246 has the effect of causing the address register 246 to point to the sub-area 276 in row E, column 1, of Table III (FIG. 15).

The print option counter 196 has been reset to 0 at this time by a signal on lead 206, and the printing of the bit pattern in column 0, row E of Table III of FIG. 15 now takes place in the same manner as the first column on a print line 148 for a print character occurs. This is, however, at print option time 7, with a 0 count in the print option counter 196, as is shown in FIG. 13 for a slash space. The sub-area 276 in column 0, row E of Table III is a single bit that calls for the printing action by the wire 124*e;* and, therefore, the first dot of the intermediate slash portion 156 for print option time 7 takes place at this time.

At the completion of this printing action by the wire 124*e*, the print option counter 196 advances in content to a 1 count, and this causes the ROS address register 246 to print to column 1, row E, Table III of FIG. 15 which contains a bit for causing the wire 124d to print during print option time 8. Similarly, when the content of print option counter 196 reaches 2 at the completion of the printing in print option time 8, the ROS address register 246 points to column 2, row E, Table III of FIG. 15 which contains a bit corresponding to the wire 124*c*. Wire 124*c* then has a printing action, providing the third of the three printed dots on the ticket 20 for completing the intermediate slash portion 156 for any of the numerators 1, 3, 5 and 7. The 2 count in the option counter 196, through decode 204 and AND circuit 214, which provides a signal through lead 216 and OR circuit 218 to counter 196, causes a resetting of counter 196 to 0, and the FIG. 14 circuit is again ready for the printing of another full character utilizing print option times 0–6, inclusive. The inverter 236 which, during the printing of the intermediate slash portion 156, has no output on line 238 disenables AND circuit 240 so that the blank space signal on line 244 cannot exist at this time and so that the contents of the sub-areas 276 in columns 0, 1 and 2, row E, Table III, can be loaded into the common print register 258 for a printing of the intermediate slash portion 156.

The next character to be printed by the same print head, such as the print head 124, is one of the denominators /2, /4 or /8 contained in stored form in rows E and F of Table II of FIG. 15. The signal on line 216 resetting the print option counter 196 at this time is also effective to advance the print buffer address register 222, so that the next output of the buffer 220 is the 6 bit character corresponding to the initial printing action to produce the /2, /4 or /8 denominator. Since these characters occur in Table II of FIG. 15, the bit 2 output of buffer 220 is a 1; and the slash decode 230 is not satisfied. There is thus no signal on line 232, and there is thus no slash space signal on line 242. Inverter 252 therefore produces a 1 in the 0 position of the ROS adrress register 246 and in addition enables AND circuits 248 and 250 for the passage of any bits 6 and 7 to positions 5 and 6 of address register 246. The output of the buffer 220 supplying bits to positions 1, 2, 3, 4, 5 and 6 of address register 246 is such that the sub-area 246 at column 0 of row F or column 8 of rows E or F of Table II in FIG. 15 is selected. For a /8 denominator, for example, the contents of the 0, 1, 2, 3, 4, 5 and 6 positions of the address register 246 will all be 1's to select the sub-area 276 at row F, column 8, of Table II. Only bit 1 is in this sub-area to cause printing action by the wire 124*b* (for print head 124), and the printing action by this wire occurs at print option time 0 for the second character which is the /8 character shown in FIG. 15. The next printing action at print option time 1 for this second character is due to the stored character in column 9, row F, Table II (FIG. 15) and causes wire 124*a* to be active. The content of the ROS address register 246 is 1111111001, and bit 0 is raised on bus 256 for this action. The other parts of the /8 character are printed as the content of the print option counter 196 increases, in the same manner as the remaining parts of any of the other characters are printed, so that the complete fraction is the ⅝ fraction shown in FIG. 13, assuming that the numerator printed is a 5.

Referring to FIG. 15, it will be apparent that the content of the 0 position of the ROS address register 246 determines whether the printer 48 shall be effective to print an intermediate slash portion 156 or a complete character involving seven option times and seven transverse print lines 148 across a ticket 20. The contents of positions 1–6 inclusive of ROS address register 246 determine which of the printed characters in Tables I and II are to be printed. The contents of the 7, 8 and 9 positions of address register 246, under the control of the output of the print option counter 196, determine the printing that shall occur at each of print option times 0–6 for a full character and at each of option times 7, 8 and 9 for a slash space character occupying the usual space between full characters.

It will be noted from FIG. 13 that the initial slash portion 154 printed with the numerator, the intermediate slash portion 156 printed in the space between full characters and the final slash portion 158 printed with the denominator are all in line and form a diagonal straight line on a ticket 20. This is true, since the wires 124*h* to 124*a* consecutively print during consecutive print option times 4, 5, 6, 7, 8, 9, 0 and 1 as shown in FIG. 13. The digits for the numerators and denominators are reduced in height so that the initial slash portion 154 may form a part of the seven option time numerator as printed and the final slash portion 158 may form a part of the seven option time denominator as printed, with the digit part of the numerator being at the upper edge of the print line 36, for example, and formed by the uppermost wire 124*a* in part and the digit part of the denominator being at the lowermost edge of the print line, being formed in part by the lowermost wire 124*h*. Thus, only the print option times for two consecutive fullsize characters including the intermediate space, and the corresponding lengthwise room required for this number of print option times, are needed for printing a fraction in lieu of the print option times and required space for three full characters which would otherwise be needed for printing a fraction. The number of print option times required for the FIG. 13 fraction is 17, while the number of print option times needed for three full characters (including two intermediate spaces) would be 27, and the saving in option times and required space along a print line 36 or 38 for printing a fraction is thus obvious. The saving in print times and required space is even more pronounced using the invention when a mixed number (such as the mixed number 7 ⅝) is printed. Using the invention, the mixed number 7 ⅝ would require the 17 print option times above mentioned in connection with the FIG. 13 fraction, the seven option times for the integer 7 and the three option times between the integer 7 and the fraction, making a total of 27 option times. Using the prior approach for printing such a mixed number, not only would the 27 print option times be required for the fraction, but the 7 option times for the integer 7 would be required; and, in addition, 13 option times would be required to provide a definite separation between the 7 and 5 of the mixed number. The total print option times in the latter case would be 47, much greater than 27.

Figure 16:
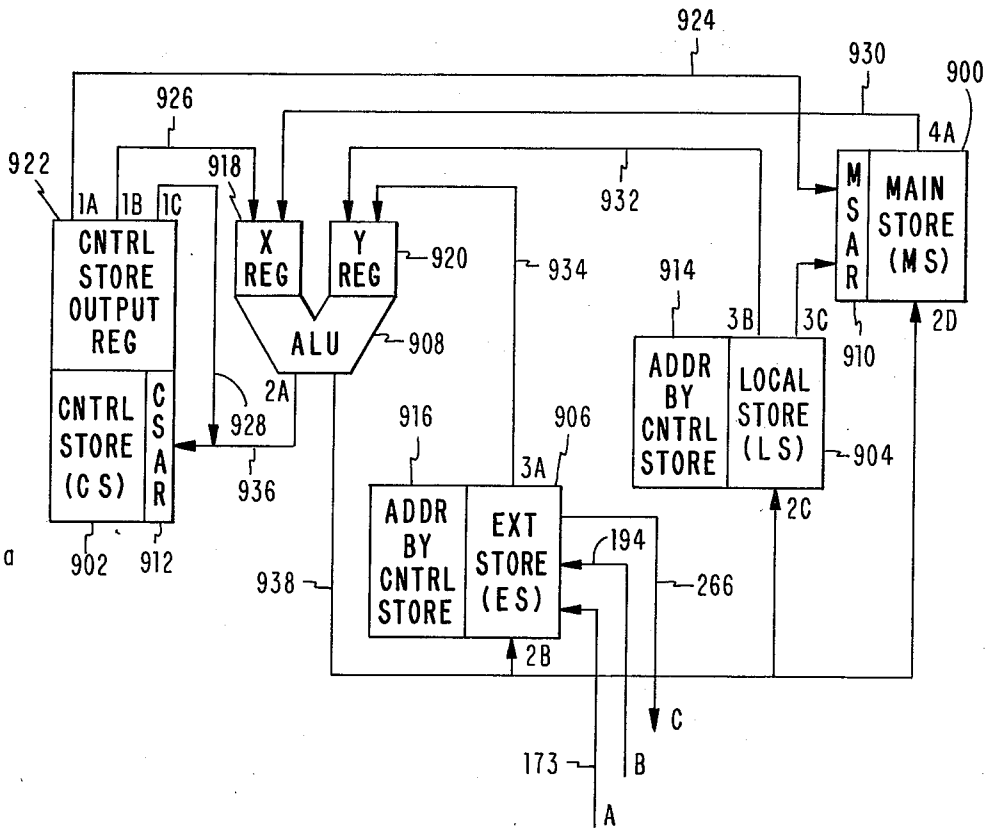
FIG. 16 is a schematic diagram of a microprogram control unit that may be used in lieu of the FIG. 14 circuit in practicing the invention.

The printing of characters on a ticket 20 using the invention may also be accomplished by the microprogram control unit shown in FIG. 16. When the FIG. 16 microprogram control unit is used, only the upper portion of the FIG. 14 circuitry located above the horizontal line *a—a* is used. In addition, the lines 178, 188 and that portion of line 186 leading to the bottom portion of the FIG. 14 circuitry are deleted. The lines 173, 194 and 266 constitute the only connections between the upper portion of the FIG. 14 circuitry and the FIG. 16 microprogram control unit, the lines 173, 194 and 266 being respectively connected to the FIG. 16 unit at points A, B and C respectively. With these connections, that portion of the FIG. 14 circuitry above the horizontal line a-a supplies signals to the FIG. 16 microcontroller which constitute pulses from the emitter 116 and the output signal of the delay counter 192 indicating when printing is to start, and the microcontroller provides outputs of data at point C that are to be printed by the print heads 124 and 126.

The FIG. 16 microprogram control unit may be seen to comprise a main store 900, a control store 902, a local store 904, an external store 906, and an arithmetic and logic unit (ALU) 908. A main store address register 910 is provided in connection with the main store, a control store address register 912 is provided in connection with the control store 902; a local store address register 914 is provided in connection with the local store 904; and an external store control register 916 is provided in connection with the external store 906. An X register 918 is provided at one input of the ALU 908, and a Y register 920 is provided at the other input of the ALU 908. A control store output register 922 is provided in connection with the control store 902.

The control store 922 is provided with outputs 1A, 1B and 1C, respectively connected with buses 924, 926 and 928 to provide inputs for the main store address register 910, the X register 918 and the control store address register 912. The main store 900 has an output 4A connected by a bus 930 to provide an input to the X register 918. The local store 904 has an output 3C connected by a bus 932 to provide an input for the Y register 920. Another bus 934 connects the store 906 with the Y register 920. The ALU 908 has an output 2A connected by a bus 936 to provide an input to the control store address register 912. The stores 906, 904 and 900 respectively have inputs 2B, 2C and 2D; and these inputs are connected by a bus 938 with another output of the ALU 908. Lines 194, 173 and 266 are connected to external store 906, and these lines are parts of the FIG. 14 circuitry as previously mentioned.

The instruction cycle for the FIG. 16 microcontrol program unit may be made up of eight clock pulses for a total time duration of 400 nanoseconds. The microcontrol program unit may include 64 registers, 32 being allocated to local store 904 and 32 being allocated to external store 906. Only some of these are used with the printing mechanism of the invention. It will be noted that communication with the outside world is done via external store 906. The local store 904 is generally used to address the main store 900 and hold temporary information.

The following abbreviations may be used for the various registers and stores in the microcontrol program unit:

CSAR = Control Store Address Register
ES = External Store (Registers)
LS = Local Store (Registers)
MAR = Main Address Register
X REG = X Register
Y REG = Y Register
CS = Control Store
MS = Main Store The following instructions may be used with the microcontrol program unit, and these respective instructions provide the following information flow:

Instruction Summary — Information Flow

Branch Unconditional (BRU):

Instruction contains address of next instruction. Low order 8 bits of new address transfered to ALU X REG via 1B, then X REG from ALU to CSAR via 2A. High order 4 bits of new address to CSAR via 1C.

Branch And Load X Register (BALX):

Instruction contains an address. Low order 8 bits of this address transferred to X REG via 1B, then Y REG transferred from ALU to CSAR via 2A. High order 4 bits of new address to CSAR via 1C.

Load X Register (LDX):

Instruction loads contents of a specified Local Store Register into MAR via 3C. Contents of this location sent to X REG via 4A. CSAR incremented by 1.

Store (ST):

Instruction loads contents of a specified L.S. Register into MAR via 3C. ALU output is then stored in this location. CSAR incremented by 1. Contents of X REG and Y REG are uncharged. Output of ALU specified by OP CODE which is part of this instruction.

Modify Register (MODR):

Contents of a specified LS (ES) register loaded into Y REG via 3B (3A). Contents of Y REG combined with X REG as specified by Op Code. Output of ALU returned to the same specified LS (ES) via 2C (2B). CSAR incremented by 1. Besides Standard Op Codes, incrementing by 1 or 2 or an end-around Shift Right available via ALU Modifier. X REG unchanged, Y REG is left with old contents of LS (ES) register.

Store Register (STRG):

Contents of ALU combined as specified by Op Code and ALU Modifier. Output of ALU stored in specified L.S. (E.S.) Register via 2C (2B) CSAR incremented by 1.

Set Bits 0–3 (SBO3):

Instruction contains a 4-bit mask which is loaded into the low order 4 bits of X REG (Exception — MASK of 0000 does not modify X REG) via 1B. Contents of a specified L.S. (E.S.) register are loaded into Y REG via 3B (3A). Low order 4 bits of X REG combined per Op Code with low order 4 bits of Y REG in ALU. High Order 4 bits of Y REG are unchanged. Output of ALU returned to the same specified L.S. (E.S.) register via 2C (2B). CSAR incremented by 1.

Set bits 4–7 (SB47):

Same as SBO3 except that the four high order bits are modified and low order 4 bits unchanged.

Skip on Bits 0–3 (SKO3):

Contents of a specified LS (ES) register are store in Y REG via 3B (3A). The instruction contains a MASK which is loaded into the low order 4 bits of X REG (Exception — MASK of 0000 does not modify X REG) via 1B. Low order 4 bits of X REG combined per Op Code with low order bits of Y REG. If the resulting four low order bits of the ALU contain any 1's, the CSAR is incremented by 2. If the four low order bits of the ALU contain all zeros, the CSAR is incremented by 1. The contents of the specified LS (ES) register remain unchanged. Exception — When "Exclusive-OR" is specified, CSAR is incremented by 2 if resulting low order bits of ALU contain all zeros.

Skip on Bits 4–7 (SK47):

Same as SKO3 except masking and comparisons performed on four high order bits.

The various routines, using the microcontrol program unit, which effectively provide the same control of print heads 124 and 126 as the FIG. 14 circuitry, are set forth hereinafter in Tables C to F; and the following information may be used for interpreting these tables:

THE LANGUAGE

Source language input to the microprogram assembler is described in mnemonic form below.

Comments

Comments are identified by an asterisk in column one. The actual comment may be located in columns 2–80 inclusive (e.g., Steps 1 through 31 are all comments).

FIELD DESCRIPTIONS

Labels

Any entry, other than a comment, may contain a label. Labels may be one to six characters long, and must always begin with an alphabetic character in column 1 (e.g. Step 35 is labeled 'RETURN'). The characters in columns two through six may be alphanumeric.

Operation Code (Op Code)

The op code must begin in column eight and may extend through column eleven.

Operand 1

Operand 1 must begin in column thirteen and may extend through column 18.

Operand 2

Operand 2 must begin in column 20 and end in column 21 for all instructions except the BALX instruction. Operand 2 of a BALX instruction starts in column 20 and ends in column 23.

Operand 3

Operand 3 must begin in column 23, and end in column 24.

Comments

Comments may begin in column 26 and continue through column 80.

Operand Mnemonics

| Operand 1 | |
|---|---|
| MSMh | Main Store Module h, where h is a hexadecimal digit 0 to F. Used in the LDX and ST instructions. |
| +0 | ALU modifier indicating that no modification is to be performed. |
| +1 | ALU modifier indicating that the ALU is to be incremented by one. |
| +2 | ALU modifier indicating that the ALU is to be incremented by 2. |
| SR1 | ALU modifier indicating that the ALU is to be shifted right one position. |
| +0, +1, +2 and SR1 | are used in the MODR and STRG instructions. |
| MASK=m | A four bit mask, where m is a hex digit 0-F. Used in the SB03, SB47, SK03, and SK47 instructions. |
| Label | Any valid step label. Used in BRU instruction. |

-continued

| Operand 1 | |
|---|---|
| **Operand 2** | |
| CSMh | Control Store Module h, where h is a hex digit in the range 0 to F. Used in BALX instruction. |
| rr | Register specification given by two hex digits in the range of 00-3F to identify the sixty-four, one byte control unit registers. Used in LDX, ST, MODR, STRG, SB03, SB47, SK03 and SK47 instructions. |
| **Operand 3** | |
| NO | No Operation in ALU. Output equals 00. |
| X | ALU output equals the X Register. |
| Y | ALU output equals the Y Register. |
| OR | ALU output equals the OR of the X and Y registers. |
| A | ALU output equals the And of the X and Y registers. |
| NY | ALU output equals the And of the X register and the Not of the Y register. |
| NX | ALU output equals the And of the Not of the X Register and the Y Register. |
| EO | ALU output equals the Exclusive OR of the X register and the Y register. |

NO, X, Y, OR, A, NY, NX and EO are known as ALU Control Parameters and are used in the ST, MODR, STRG, SB03, SB47, SK03 and SK47 instructions.

Instructions

Branch Unconditional (BRU)

Label Field — Any valid label

Op Code — BRU

Operand 1 — A defined label

Operands 2 and 3 — Blank

Example: HERE BRU THERE (instruction labeld HERE produces an unconditional branch to instruction labeled THERE).

Branch And Load X Register (BALX)

Label Field — Any valid label

Op Code — BALX

Operand 1 — A defined label

Operand 2 — CSMh

Operand 3 — Blank in last position

Example: THERE BALX HERE CSM1 (instruction labeled THERE creates unconditional branch to instruction HERE in C.S. module 1. 'HERE' remains in X REG).

Load X Register (LDX)

Label Field — Any valid label

Op Code — LDX

Operand 1 — MSMh (specified Main Store Module being addressed)

Operand 2 — rr (specifies L.S. register containing address)

Operand 3 — ALU Control

Example: LABEL1 LDX MSMO 3E NO (instruction labeled LABEL1 loads XREG with contents of MSMO, location specified by contents of L.S. register 3E)

Store (ST)

Label Field — Any valid label

Op Code — ST

Operand 1 — MSMh (specified Main Store Module being addressed)

Operand 2 — rr (specified L.S. register containing address)

Operand 3 — ALU Control

Example: LABEL2 ST MSM1 3B NO (instruction labeled LABEL2 stores output of ALU "00" in MSM1 at location specified by L.S. register 3B)

Modify Register (MODR)

Label Field — Any valid label

Op Code — MODR

Operand 1 — ALU Modifier

Operand 2 — rr (specifies L.S. or E. S. register being modified)

Operand 3 — ALU Control

Example: LABEL3 MODR +0 04 A (instruction labeled LABEL3 And's contents of register 04 with contents of XREG and returns result to register 04)

Store Register (STRG)

Label Field — Any valid label

Op Code — STRG

Operand 1 — ALU Modifier

Operand 2 — rr (specified L.S. or E.S. register being stored)

Operand 3 — ALU Conrol

Example: LABEL4 STRG +0 0A X (instruction labeled LABEL4 stores contents of XREG in register OA)

Set Bits 0–3 (SBO3)

Label Field — Any valid label

Op Code — SBO3

Operand 1 — MASK=m

Operand 2 — rr (specifies L.S. or E. S. register whose bits are to be set)

Operand 3 — ALU control

Example: LABEL5 SBO3 MASK=B 10 EO (instruction labeled LABEL5 Exclusive Or's bits 0–3 of register 10 with a mask=B. Bits 4–7 remain unmodified)

Set Bits 4–7 (SB47)

Label Field — Any valid label

Op Code — SB47

Operand 1 — MASK=m

Operand 2 — rr (specifies L.S. or E.S. register whose bits are to be set)

Operand 3 — ALU Control

Example: LABEL6 SB47 MASK-7 23 A (instruction labeled LABEL 6 And's bits 4–7 of register 23 with a mask=7. Bits 0–3 remain unmodified.)

Skip On Bits 0–3 (SKO3)

Label Field — Any valid label

Op Code — SKO3

Operand 1 — MASK=m

Operand 2 — rr (specifies L.S. or E.S. register being tested)

Operand 3 — ALU Control

Example: LABEL7 SKO3 MASK=C 34 A (instruction labeled LABEL7 And's bits 0–3 of register 34 with a mask=C, if result of this operation contains any one's, the next instruction is skipped, otherwise the next instruction is executed).

Skip On Bits 4–7 (SK47)

Label Field — Any valid label

Op Code — SK47

Operand 1 — MASK=m

Operand 2 — rr (specifies L.S. or E.S. register being tested)

Operand 3 — ALU Control

Example: LABEL8 SK47 MASKS=3 04 A (instruction labeled LABEL8 And's bits 4–7 of register 04 with a mask=3, if this results in any 1's, the next instruction is skipped. Otherwise the next instruction is executed).

End (END)

Label Field — Any valid label

Op Code — END

Operands 1, 2 and 3 — Blank

The following Tables C to F set forth the various routines that may be used with the microcontrol program unit illustrated in FIG. 16 for providing substantially the same control of the printer 48 as is provided by the full FIG. 14 circuitry, and the following Tables A and B set forth the register and main store assignments that may be used in connection with these routines:

TABLE A

| REGISTER | REGISTER ASSIGNMENTS FOR RETAIL INDUSTRY PRINT ROUTINE |
|---|---|
| 01 | WORK REGISTER WHERE PRINT FLAGS FOR ACTIVE LINE ARE STORED<br>BIT 1 NEW PRINT CHARACTER FLAG<br>BIT 2 PRINT SPACE FLAG<br>BIT 7 MSM3 PRINT BIT (ROS PRINT MATRIX MSM3 IF ON, MSM2 IF OFF |
| 04 | WORK REGISTER WHERE ACTIVE LINE'S PRINT CHARACTER COUNTER IS KEPT |
| 05 | WORK REGISTER WHERE ACTIVE LINE'S WIRE ADDRESS POINTER IS KEPT |
| 08 | BITS 4–7 EMITTER COUNTER |
| 1F | MAIN STORE ADDRESS POINTER |
| 28 | COMMON PRINT OUTPUT REGISTER |
| 29 | BIT 7 PRINT OP |
| 2F | BIT 4 100 USEC INTERRUPT |

TABLE B

| MAIN STORE ASSIGNMENTS FOR RETAIL INDUSTRY PRINT ROUTINE | |
|---|---|
| MSM0 | POS 00 THRU 7F — PRINT LINE 1 BUFFER |
| MSM0 | POS 80 THRU FF — PRINT LINE 2 BUFFER |
| MSM1 | POS 60 — PRINT LINE 1 FLAGS |
| MSM1 | POS 61 — PRINT LINE 1 CHARACTER COUNTER |
| MSM1 | POS 62 — PRINT LINE 1 WIRE ADDRESS POINTER |
| MSM1 | POS 70 — PRINT LINE 2 FLAGS |
| MSM1 | POS 71 — PRINT LINE 2 CHARACTER COUNTER |
| MSM1 | POS 72 — PRINT LINE 2 WIRE ADDRESS POINTER |
| MSM2 | AND MSM3 — ROS PRINT CHARACTER TABLE |
| MSM4 | — ROS PRINT SLASH CHARACTER DECODE |

TABLE C

| COL 1 | OP CODE | OP 1 | OP 2 | OP 3 | COMMENTS |
|---|---|---|---|---|---|
| | | EMITTER SERVICE ROUTINE ( EVERY 100 USEC EMITTER ) | | | |
| RETURN | SK47 | MASK=8 | 2F | A | SKIP IF 100 USEC INTERRUPT |
| | BRU | A | | | GO TO SERVICE OTHER INTERRUPTS (NOT SHOWN) |
| | SB47 | MASK=8 | 2F | NX | RESET 100 USEC EMITTER INTERRUPT |
| | MODR | +1 | 08 | Y | INCREMENT 100 USEC EMITTER COUNTER |
| EMCT5 | SK47 | MASK=5 | 08 | EO | SKIP IF EMITTER COUNTER = 5 |
| | BRU | EMCT10 | | | |
| | SB03 | MASK=7 | 1F | X | SET MAIN STORE ADDRESS POINTER TO 7X FOR LINE 2 |
| | BRU | PRINT | | | GO TO PRINT ROUTINE |
| EMCT10 | SK47 | MASK-=A | 08 | EO | SKIP IF EMITTER COUNTER = 10 |
| | BRU | B | | | GO TO SERVICE NON-PRINT EMITTER COUNTS (NOT SHOWN) |
| | SB47 | MASK=F | 08 | NX | RESET EMITTER COUNTER TO O |
| | SB03 | MASK=6 | 1F | X | SET MAIN STORE ADDRESS POINTER TO 6X FOR LINE 1 |
| | BRU | PRINT | | | GO TO PRINT ROUTINE |

TABLE D

| | | MOVE PRINT LINE 1 OR LINE 2 FLAGS TO COMMON WORK REGISTERS | | | |
|---|---|---|---|---|---|
| PRINT | SK47 | MASK=1 | 29 | A | SKIP IF PRINT OP IS ON |
| | BRU | RETURN | | | GO TO SERVICE OTHER FUNCTIONS |
| | SB47 | MASK=F | 1F | NX | SET MAIN STORE ADDRESS POINTER TO 60 (L1) OR 70 (L2) |
| | LDX | MSM1 | 1F | NO | BRING PRINT FLAGS TO X REGISTER |
| | STRG | +0 | 01 | X | AND STORE IN LSR01 |
| | SB47 | MASK=1 | 1F | X | SET MAIN STORE ADDRESS POINTER TO 61 (L1) OR 71 (L2) |
| | LDX | MSM1 | 1F | NO | BRING PRINT CHARACTER COUNTER TO X REGISTER |
| | STRG | +0 | 04 | X | AND STORE IN LSR04 |
| | SB47 | MASK=2 | 1F | X | SET MAIN STORE ADDRESS POINTER TO 62 (L1) OR 72 (L2) |
| | LDX | MSM1 | 1F | NO | BRING WIRE ADDRESS POINTER TO X REGISTER |
| | STRG | +0 | 05 | X | AND STORE IN LSR05 |
| | BRU | PRCOM | | | |

TABLE E

| OOL 1 | OP CODE | OP 1 | 2 | OP 3 | COMMENTS |
|---|---|---|---|---|---|
| | | PRINT ROUTINE COMMON FOR LINES 1 AND 2 | | | |
| PRCOM | SK03 | MASK=2 | 01 | NY | SKIP IF NOT SPACE FLAG |
| | BRU | SPACE | | | |
| | SK03 | MASK=4 | 01 | A | SKIP IF NEW PRINT CHARACTER FLAG |
| | BRU | PRWIRE | | | |
| | LDX | MSMO | 04 | NO | FETCH PRINT CHARACTER FROM PRINT CHARACTER BUFFER |

TABLE E-continued

| OOL 1 | OP CODE | OP 1 | 2 | OP 3 | COMMENTS |
|---|---|---|---|---|---|
| | | | PRINT ROUTINE COMMON FOR LINES 1 AND 2 | | |
| | STRG | +0 | 05 | X | AND STORE IN LSR05 |
| | MODR | SR1 | 05 | Y | ROTATE CHARACTER RIGHT 1 POSITION |
| | MODR | SR1 | 05 | Y | ROTATE RIGHT 2 POS |
| | MODR | SR1 | 05 | Y | ROTATE RIGHT 3 POS |
| | MODR | SR1 | 05 | Y | ROTATE RIGHT 4 POS |
| | MODR | SR1 | 05 | Y | ROTATE RIGHT 5 POS TO USE FOR WIRE ADDRESS POINTER |
| | SB47 | MASK=1 | 01 | NX | REST MSM3 PRINT BIT |
| | SK47 | MASK=1 | 05 | NY | SKIP IF NOT PRINT FROM MSM3 |
| | SB47 | MASK=1 | 01 | OR | SET MSM3 PRINT BIT |
| | SB03 | MASK=4 | 01 | NX | TURN OFF NEW PRINT CHARACTER FLAG |
| | MODR | + 1 | 04 | Y | INCREMENT PRINT CHARACTER COUNTER |
| | SB47 | MASK=7 | 05 | NX | RESET LOWER 3 BITS FOR USE AS PRINT OPTION COUNTER |
| PRWIRE | SK47 | MASK=1 | 01 | A | SKIP IF PRINT CHARACTER TRANSLATE IN MSM3 |
| | BRU | PWIRE1 | | | |
| | LDX | MSM3 | 05 | NO | FETCH PRINT WIRES FROM PRINT ROS IN MSM3 |
| | BRU | PWIRE2 | | | |
| PWIRE1 | LDX | MSM2 | 05 | NO | FETCH PRINT WIRES FROM PRINT ROS IN MSM2 |
| PWIRE2 | STRG | +0 | 28 | X | AND STORE IN COMMON PRINT REGISTER |
| | SK47 | MASK=6 | 05 | NY | SKIP UNTIL PRINT OPTION COUNTER = 6 |
| | BRU | PRESET | | | |
| PRINCR | MODR | +1 | 05 | Y | INCREMENT PRINT OPTION COUNTER |
| | BRU | PREND | | | |
| SPACE | SK03 | MASK=E | 05 | NY | SKIP UNLESS LAST PRINT CHARACTER = EX OR FX |
| | SK47 | MASK=1 | 01 | NY | SKIP IF LAST PRINT CHARACTER IN MSM2 (SLASH REQUIRED) |
| | BRU | SPACE2 | | | |
| | SB03 | MASK=1 | 05 | NX | RESET BIT 5 OF ROS ADDRESS ( NOW = EX ) |
| | LDX | MSM4 | 05 | NO | FETCH PRINT WIRES FOR SLASH FROM MSM4 |
| | STRG | +0 | 28 | X | AND STORE IN COMMON PRINT REGISTER |
| SPACE1 | SK47 | MASK=2 | 05 | EO | SKIP IF PRINT OPTION COUNTER = 2 |
| | BRU | PRINCR | | | |
| | SB03 | MASK=4 | 01 | X | TURN OFF SPACE FLAG AND TURN ON NEW PR CHAR |
| | BRU | PREND | | | |
| SPACE2 | MODR | +0 | 28 | NO | RESET COMMON PRINT REGISTER |
| | BRU | SPACE1 | | | |
| PRESET | SB03 | MASK=2 | 01 | OR | TURN ON SPACE FLAG |
| | SB47 | MASK=F | 05 | NX | RESET PRINT OPTION COUNTER |
| | BRU | PREND | | | |

TABLE F

| | | | | | |
|---|---|---|---|---|---|
| | | MOVE PRINT LINE 1 OR LINE 2 FLAGS BACK TO MAIN STORE | | | |
| PREND | MODR | +0 | 05 | Y | BRING PRINT WIRE ADDRESS COUNTER TO Y REGISTER |
| | ST | MSM1 | 1F | Y | AND STORE IN MSM1 POS 62 (L1) OR 72 (L2) |
| | SB47 | MASK=1 | 1F | X | SET MAIN STORE ADDRESS POINTER TO 61 (L1) OR 71 (L2) |
| | MODR | +0 | 04 | Y | BRING PRINT CHARACTER COUNTER TO Y REGISTER |
| | ST | MSM1 | 1F | Y | AND STORE IN MSM1 POS 61 (L1) OR 71 (L2) |
| | SB47 | MASK=F | 1F | NX | SET MAIN STORE ADDRESS POINTER TO 60 (L1) OR 70 (L2) |
| | MODR | +0 | 01 | Y | BRING PRINT FLAGS TO Y REGISTER |
| | ST | MSM1 | 1F | Y | AND STORE IN MSM1 POS 61 (L1) OR 71 (L2) |
| | BRU | RETURN | | | |

The registers that are used in the microprogram control unit of FIG. 16 are listed in Table A, and these registers are contained in local store 904 and external store 906. Five of these registers are in local store 904 and three of these registers are in external store 906, eight registers being used in all. Local store 904 and external store 906 each contain a total of 32 registers (all 8 bits wide), and the remaining ones of these registers may be used for other purposes; and the microprogram control unit of FIG. 16 may be used for other functions for controlling the FIG. 2 machine, for example. The main difference between the registers of external store 906 and the registers of local store 904 is that the registers of external store 906 may receive information from external sources and deliver information to such external sources, while the registers in local store 904 are used completely for internal manipulation of bits within the microcontroller. The first five registers listed in Table A are in local store 904, these being registers 01, 04, 05, 08 and 1F. The last three registers listed in Table A, namely, registers 28, 29 and 2F are in external store 906. Line 194 is connected to bit position 7 of register 29, and line 173 is connected to bit position 4 of register 2F. The eight bit positions of register 28 are connected to bus 266.

The information in the form of bits used in the registers 01, 04 and 05 of Table A are originally contained in the parts of main store 900 listed in Table B. These bits are transferred from main store 900 to the various registers listed in Table A mainly for the purpose of testing these bits as is required for carrying on the microprogram; and after the testing has been completed using the registers of Table A, the bits are then returned to main store 900 and to the particular parts thereof listed in Table B. The bits that are transferred from main store 900 to the registers of Table A and back again to the parts of main store 900 listed in Table B are flag bits, counter bits, etc.

Referring to Table B, and 0 module of main store 900 (listed in step 22 as "MSMO") corresponds to the print buffer 220 in the FIG. 14 circuitry. As shown in steps 22 and 23 of Table B, positions 00-7F are used for the print line 1 buffer (220*a*) and positions 80-FF are used for the print line 2 buffer (220*b*). Three 8 bit bytes are stored, in addition, in main store 900 for print line 1 (print line 36), these being in a main store module 1 and being respectively in positions 60 61 and 62 thereof. These 8 bit bytes are flags, character counter bits and wire address pointers for print line 1 (print line 36). In addition, there are similar bits stored in main store module No. 1, in positions 70, 71 and 72, for print line 2 (print line 38). The bits in positions 60, 61, 62, 70, 71 and 72 of the No. 1 module of main store 900 are pulled out of main store 900 and are stored in some of the local work registers listed in Table A, Specifically in registers 01, 04 and 05 used during the print routine.

Referring further to Table B, main store 900 also contains modules 2 and 3; and, as indicated by step 30, these modules contain the read only store character table which is Tables I and II of FIG. 15 and is part of the matrix table 254 shown in FIG. 14. There is still another module (No. 4) in main store 900; and, as shown in step 31 of Table B, this contains a ROS print slash character decode, which is equivalent to Table III of FIG. 15.

The functions of the various registers in Table A with respect to the various flag bits etc. in Table B will now be described.

Figure 17:
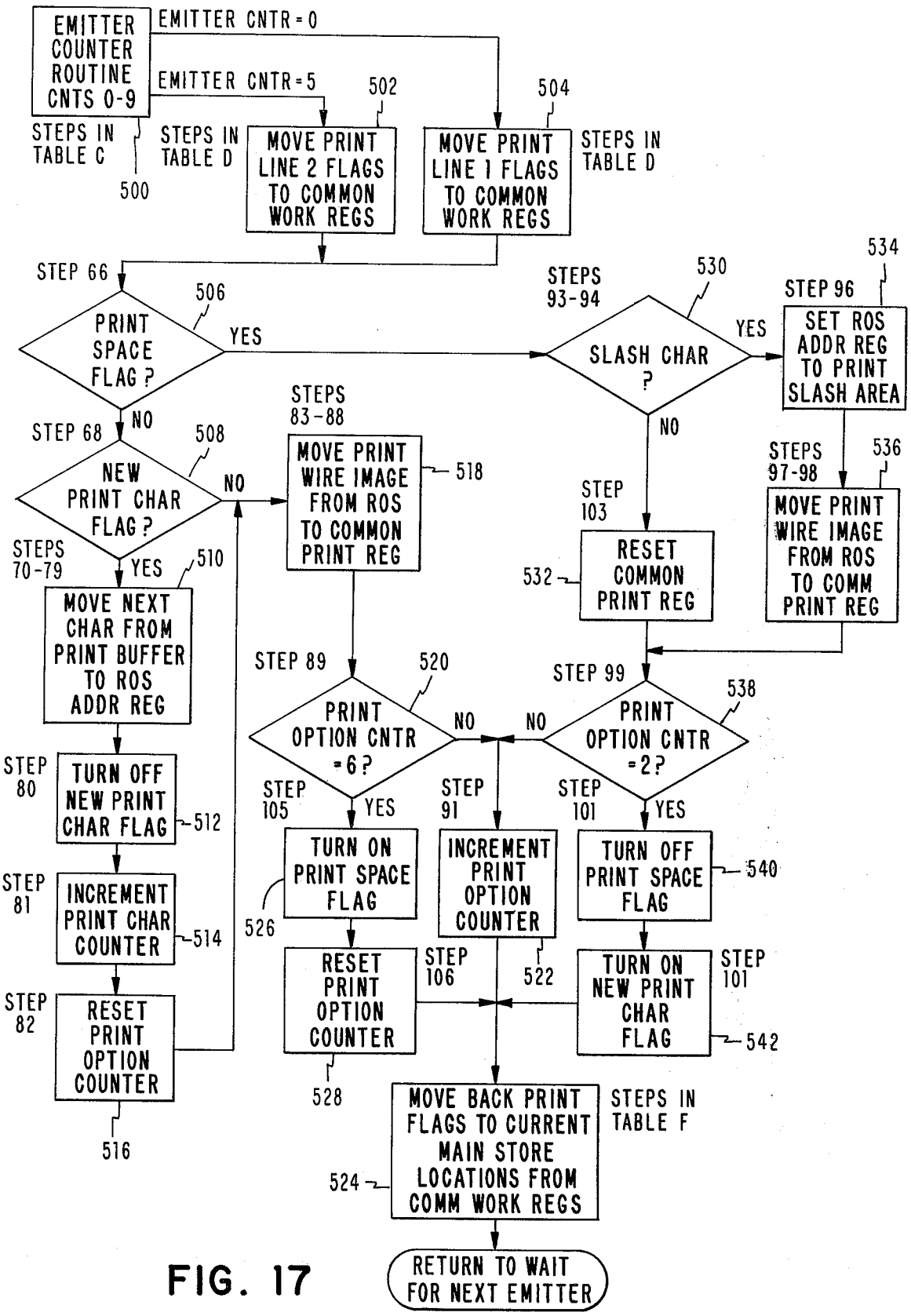
FIG. 17 is a flow diagram illustrating the program for the microprogram control unit of FIG. 16 for producing the same printing action as the FIG. 14 circuit.

It will be apparent from FIG. 17 that, at the beginning of the print routine, a common routine is used for both of the print lines 1 and 2 (print lines 36 and 38). Either the bits in position 60 or those in position 70 of MSM1 are moved to register 01 (step 7), and these bits are tested during the print routine. Register 01, although it is 8 bits long, is only used for 3 bits of its capacity during the print routine, these three bits being bit 1, bit 2 and bit 7. As shown by step 8, bit 1 position contains a new print character flag, and this flag is used any time a new print character is to be fetched from the MSMO buffer (see steps 22 and 23). This would correspond to print option time 0 in the FIG. 14 hardware controls. Bit 2 position of register 01 (see step 9) contains the print space flag which is equivalent to the output of the space flip latch on line 212 of the FIG. 14 hardware controls, and this bit is used to govern the printing of a full character of the three slash dots between characters. Bit 7 of register 01 (see step 10) is a bit that indicates which of the print buffers (MSM2 or MSM3) will be used for providing a character to be printed (see step 30).

It will be noted from FIG. 14 that the ROS address register 246 has 10 inputs (which may be on a single bus). The microprogram control unit of FIG. 16, however, operates in 8 bit bytes; and bit 7 of register 01 is an overflow bit which is equivalent to the 1 bit of the address register 246 in the FIG. 14 embodiment. Incidentally, referring to FIG. 16, the address register 910 may be seen to have two paths into it (from local store 904 and from bus 924). The 3C output of local store 904 is an 8 bit bus, while the bus 924 carries 4 bits, and these are used together so as to address main store 900 by means of MSAR 910. This is 12 bits total of which ten of the bits are for printing, while the remaining two bits may be used for other devices (not shown) under the control of the FIG. 16 microcontroller.

Register 04 of Table A is the receptor of the contents of MSM1 position 61 or position 71, depending on which of the print lines is printed, and constitutes the character counter which is equivalent to the character counter 224 in the FIG. 14 embodiment. The FIG. 16 microcoding application, however, in lieu of using an equivalent of the flip flop 226, divides the equivalent address register corresponding to register 222 into two parts. The microcoding in effect, therefore, duplicates the counter 224 in lieu of using the flip flop 226 or the equivalent. These two counters address MSMO, positions 00-7F, and MSMO, positions 80-FF (see steps 22 and 23). In the case of the microcoding embodiment, it is simpler to use the two counters, since there is an abundance of storage space, and instructions are thereby saved.

Register 05 (see step 12) is a work register where a wire address pointer is kept. This pointer comes from either position 62 or position 72 of MSM1 (see steps 26 and 29). The wire address pointer is equivalent to bits 2–9 of the ROS address register 246 in the FIG. 14 hardware embodiment.

Register 08 (see step 15), bits 4–7, are used for a 4 bit emitter counter which is a duplication of the emitter counter 174 of the FIG. 14 hardware controls. The bits in register 08 provide the signals required in testing for the microcode application.

Register 1F (Table A) constitutes a main store address pointer. This is a dedicated register that is used for the addressing function of the signals carried by line 3C in the FIG. 16 microcontroller.

Register 28 (see step 15), which is the first of the three external store registers, is equivalent to the common print register 258 in the FIG. 14 hardware embodiment of the controls. The output register 28 is used to interface with respect to the PL1 register 270 and PL2 register 268. As has been previously described, the hardware registers 268 and 270 are used with both the microcontroller of FIG. 16 as well as with the hardware embodiment which is shown mainly below the horizontal line *a—a* of FIG. 14.

Register 29 (step 16 of Table A), bit 7, "print op", contains a bit that is equivalent to the signal on the line 194 and the output of the delay counter 192.

Register 2F (step 17), bit 4, contains a 100 microsecond interrupt bit. There is a latch (not shown), internal of the microcontroller of FIG. 16, which is a portion of the external store 906, and can be set by an external pulse, (in this case, the pulse from the emitter 173); and the content of this latch can be sampled to determine if a 100 microsecond interrupt has occurred for a performance of the required microcontroller steps for printing. One service of the microroutine is obtained per pulse from emitter 116 in this manner. Since the interrupting of the operation of the microcontroller for print and other operations is not per se a part of the present invention, no further details on the interrupting sequence or microprogram therefor is deemed necessary.

Table C contains the instructions for doing what is shown in Block 500 of FIG. 17. Steps 35 and 36 are used for sampling to determine if there is a 100 microsecond interrupt (for printing). If there is not, the microcontroller services other interrupts as indicated by step 36. These other interrupts could, for example, be a 50 microsecond interrupt for reading using read head 46 or a 416 microsecond interrupt for run control of the FIG. 2 machine. If there is a 100 microsecond interrupt, then the microprogram goes to step 37 by means of which the interrupt (register 2F) is reset; and the 100 microsecond emitter counter (register 08) is then incremented as indicated by step 38. Then a test of emitter counter register 08 is made as indicated by step 39, and, if the content of the emitter counter register 08 is 5, the program sets up for the steps that must be made for a printing of line 2. It will be noted in the instructions set forth in step 41 that the main store address pointer (register 1F) is set to the 70 address of main store 900 for a printing of line 2. Then, a branch is made to the Table D routine, the branch being accomplished by the instruction shown as step 42.

If the count in emitter counter register 08 does not equal 5, then a branch is made to "EMCT 10 (step 43)", accomplished by step 40. In accordance with step 43, a test is made to determine if the content of emitter counter is equal to 10. If the emitter counter does contain a count of 10, the counter is reset to 0 in accordance with step 45, and the main store address pointer (register 1F) is set according to step 46 to 60. Therefore, the flags for line 1 (MSM1, position 60) will now be pulled out of register 01. Then, the routine in Table D occurs. If it turns out that the content of the emitter counter is not equal either to 5 or to 10, then a branch is made to location B in control store 902 as in step 44, which handles all the nonprint emitter counts, such as writting by means of write head 44, reading by means of read head 46, etc.

Referring to Table D, the steps in this table indicate the manner in which the flags for line 1 or line 2 printing are brought to the common work registers. In step 51, a sampling is made to determine if the print op bit (register 29, bit 7) is on. If it is not on, a branch is made back to "return", step 35, since printing requires no service at this time. If the print op bit is on, the instruction in step 53 is next. Steps 53 to 62, inclusive, are simply effective to pull out the flags of main store 900 and store them into the various registers of Table A. The instruction of step 53 is such as to turn off the bottom bits of the main store address pointer (register 1F) so that it will now point to either 60 or 70. "60" is the location in main store 900 for the line 1 flags, and "70" is the location for the line 2 flags. These locations were respectively set up in step 46 and step 41. Then, the print flags for which ever line is to be printed is brought to the X register in step 54; and they are also stored in register 01. Then, the lower half of the address for main store 900 is changed so that the address is either 61 or 71 as set forth in step 56; and the print character counter content is brought to the X register as set forth in step 57. The print character counter content is then stored in register 04, and the main store address pointer is then changed to 62 or 72 as set forth in step 59. The wire address pointer is then stored in the X register as set forth in step 60 and wire address pointer is then stored in local store 05 (step 61). This completes the description of the steps in Table D, and this series of steps is indicated in both blocks 502 and 504 of FIG. 17. Whether the steps of block 502 or those in block 504 are effective is dependent on which address was initialized for a print line.

Table E sets forth the steps that are used in the print routine which is common for both lines 1 and 2 (print lines 36 and 38). In this routine, first a test is made to determine whether a space is being printed or a main character is being printed. This is decision block 506 and, in particular, is the instruction in step 66 of Table E. This is equivalent to a sampling of the output of the space latch 210, in the FIG. 14 hardware embodiment, on line 212. When the Table E print routine is initially effective, the printing of a character is being started; and the space flag (bit 2, register 01) will not be on, so a branch is made to step 68, decision block 508, wherein a test is made to determine if there is a new print character flag (bit 1, register 01). The run control (not shown) when it is initialized for printing, turns on the new print character flag in register 01 so, therefore, the query is of block 508 answered "yes"; and step 70 is the next step. At this point, the first character for print line 1 is fetched from the print character buffer, and this is stored in local store register 05. The character buffer 220 in the FIG. 14 hardware embodiment of the controls provides a 6 bit output, on bus 228. The corresponding 6 bits, in the FIG. 16 microcontroller move into the bottom 6 bit positions of local store register 05. Local store register 05 at this time is used equivalently to the ROS address register 246 in the FIG. 14 embodiment, so these bits must be moved into positions that allow the print option counters to come in at the lower 3 bit positions of register 05. This is accomplished in steps 72–76 by means of which the character in register 05 is rotated right one position during each step. At the conclusion of this process, bits 3–7 are in the top positions of register 05. Bits 7 and 8 are both 0 corresponding to no output out of 0 and 1 bit positions on bus 228 and bit 9 has thereon the equivalent of bit 2 on bus 228. At this point, the so-called MSM3 print bit (in bit 7 position of register 01) is turned off (step 77) and then a determination is made whether the 1 bit is on in the bottommost position of register 05 (corresponding to bit 2 out of buffer 220). If this bit is on, then in step 79, the MSM3 print bit is turned on (the bit that is in position 7 of registor 01). With this bit on, printing will be made out of main store module 3. If this bit is off, printing will be out of main store module 2. The print character, at this time, is configured in condition in which it can be used in the microcontroller addressing scheme.

In step 80, the new print character flag is turned off (in bit 1 position of register 01) as is shown by block 512, signifying that the print character has been pulled out of store 900 and has been reconfigured. In step 81, (block 514), the print character counter (MSM1 position 61 or position 71) is incremented so that the next time the print character flag (MSM1, position 60 or 70) is turned on, the print character is taken out of the next location in store 900. At this point, the bottom 3 bits of register 05 are reset for use as a print option counter. Specifically, bit 7 therein is the bit that is being reset at this time (this bit is equivalent to bit 9 of the ROS address register 246 in the FIG. 14 embodiment).

At this point, the program proceeds to block 518, steps 83–88, and the print wire image is moved from read only storage (MSM2 or MSM3) to the common print register (register 28); however the additional steps are required to test to determine if bit 7 of register 01 is on and whether the data should be coming in from main store module 2 or main store module 3. Initially, in step 83, a test is made to determine if the data should be from MSM3; and, if so, then step 85 is next, and the data is brought from MSM3. Step 88 is then next under these conditions whereby this data is stored in the common print register (register 28). If the MSM3 bit is off, then step 84 is the next step, which proceeds to steps 87 and 88 by means of which the data is brought from MSM2 to the common print register (register 28).

Step 89 (block 520) is next, and consists in testing of the print option counter) the bottom 3 bits of register 05) to determine if its contents equal 6. This is similar to the action of the counter decode 204 in the FIG. 14 embodiment. If the contents of the counter does not equal 6, a skip is made to step 91 whereby the print option counter is incremented. This is shown in block 522 of FIG. 17. This is the path that is followed for the first time through the print routine, and step 92 is then effective which takes the control to Table F. At this time, all of the print flags that have been worked on are stored back into the current main store module, which in this case is MFM1, position 60–62 for line 1. This is for count 0 from the emitter 116.

When the emitter reaches count 5, then instead of proceeding through block 504, the program passes through block 502, pulling out the print flags from MSM1, position 70, for line 2 printing. In this case, the new print character flag will be on (in register 01); the character will be rotated; and the program continues on through the print routine as for line 1, passing through blocks 508, 510, 512, 514, 516, 518, 520 and 522 to print the first dots for line 2. This continues until block 520 is reached in the sixth print option time of line 1 at which time the print space flag (bit 2 of register 01) is turned on and the lower 3 bits of register 05 (the print option counter), are reset as set forth in block 528. At the next time that print line 1 is serviced, at block 506, the space flag (bit 2 of register 01) is sampled and will be found to be on. Dependent on what the character was that was originally pulled out of the MSM0 buffer, and if it was not a slash character, this action being similar to that of the decode 230, the common print register 28 will be reset (block 532). Otherwise, the program will continue to obtain the dot matrix required for a slash character.

The steps shown in blocks 530, 532, 534 and 536 will now be described in some detail. Steps 93 and 94 of Table E set forth specifically the manner in which the microcoding decodes a slash character. It is seen, in the case of the FIG. 14 hardware embodiment, that bits 3, 4 and 5 out of buffer 220 are on for a slash character. The corresponding bits in the microprogram have come to reside in top 3 bit positions of register 05, after the rotation above explained, so step 93 sets bits 3, 4 and whereby that they are all on at the same time. Step 94 sets forth the manner in which a test is made to determine if bit 2 was initially off. It will be remembered that this bit was tested and moved to register 01 previously. If the character to be printed is not a slash, step 95 is next which branches the microprogram to step 103 to reset the common print register (register 28). If the character to be printed is to be a slash, then bit 5 of the ROS address is reset. This is equivalent to the action of AND block 248 in the hardware embodiment of FIG. 14. An action corresponding to that of AND block 250, which is also used in the slash situation, was accomplished previously when the print option counter (the bottom 3 bits of register 05) had its contents first equal to 6 and was reset in step 106.

Continuing with slash printing, the slash print wire representation is loaded from MFM4 and is stored in the common print register (steps 97 and 98 block 536). After the microprogram has passed through the print space or print slash printing for the first time, the contents of the print option counter equals 0, so that when the counter is tested in block 538, step 99, the contents will not equal 2, and the program goes to step 91 in which the print option counter is incremented. This continues for the three option times for the space; and, at the last time through, the content of the option counter does equal 2; and, instead of simply incrementing the option counter, the print space flag (bit 2 of register 01) is turned off. This is equivalent to resetting the print space latch 210 of the FIG. 14 hardware embodiment. At this time, the new print character flag will be turned on, in step 101, block 542. This will cause the print routine to pull out the next print character from MSM0 on the next time that it advances, because there will be a "no" decision in block 506 and a "yes" decision in block 508.

We claim:

1. Printing mechanism comprising a print head carrying a plurality of individual dot printing means; said individual dot printing means being disposed in a row having a first or end portion, a second or middle portion and a third or other end portion;

means for holding a record medium in close proximity to said dot printing means so that said dot printing means are active to print dots on the record medium when the dot printing means are actuated;

means for providing relative movement between said print head and record medium so that said plurality of individual dot printing means may print dots on a series of parallel lines extending longitudinally of said record medium;

motion responsive means driven in timed relationship with the relative movement between said record medium and said print head for controlling the printing by said dot printing means so that said dot printing means may print on spaced lines extending transversely across the record medium corresponding to said row of dot printing means;

means under the control of said motion responsive means for controlling all three of said row portions of said dot printing means so that said dot printing means of all three of said row portions are effective to print a pair of consecutive full-sized characters on said record medium on first and second groups of said transverse lines;

means under the control of said motion responsive means for providing a space between said two groups of transverse lines consisting of one or more of said transverse lines on which none of said individual dot printing means is effective to print;

means under the control of said motion responsive means for alternately controlling only said first and second row portions of said dot printing means in lieu of said three row portions in order to print a shortened character within said first group of transverse lines;

means under the control of said motion responsive means for subsequently controlling only said second and third row portions of said dot printing means for printing a subsequent shortened character on said record medium within said second group of transverse lines; and means under the control of said motion responsive means for consecutively actuating said individual dot printing means toward one end of said row from the other end of said row as said row of dot printing means consecutively crosses said transverse lines including transverse lines of said first group, said space, and said second group so as to provide a diagonally extending slash mark defined by printed dots on transverse lines of said two groups and space and between said shortened printed characters.

2. Printing mechanism as set forth in claim 1, each of said individual dot printing means including a longitudinal moveable print wire and means for thrusting said print wire into printing relationship with respect to said record medium to thereby actuate said dot printing means.

3. Printing mechanism as set forth in claim 1, said individual dot printing means each including a print wire moveable longitudinally into printing relationship with said record medium and an electromagnet for moving said print wire, said row of print wires being straight and extending at right angles to the direction of relative movement between said print head and record medium so that said transverse lines across said record medium are straight and extend at right angles to the direction of relative movement between said print head and record medium.

4. Printing mechanism as set forth in claim 1, said individual dot printing means each including a print wire moveable longitudianlly into printing relationship with said record medium and said row of print wires being straight so that said transverse lines extending across said record medium are straight, said end portions of said row of dot printing means each including two such print wires and said middle portion of said row of dot printing means including four such print wires.

5. Printing mechanism as set forth in claim 1, said means controlling all three of said row portions and said means for alternately controlling only said first and second row portions and said means for subsequently controlling only said second and third row portions of said dot printing means including a store having a plurality of locations therein which correspond with said dot printing means that shall be actuated to print on said transverse lines, and means for addressing each of said store locations for causing a corresponding printing action by said dot printing means to take place.

* * * * *